US005146134A

United States Patent [19]

Stadler et al.

[11] Patent Number: 5,146,134

[45] Date of Patent: Sep. 8, 1992

[54] HALOGEN INCANDESCENT LAMP, PARTICULARLY FOR OPERATION FROM POWER NETWORKS, AND METHOD OF ITS MANUFACTURE

[75] Inventors: Karl Stadler, Adelschlag; Roland Stark, Wellheim; Ruediger Klam, Eichstaett; Rupert Muehlberger, Ingolstadt; Michael Brinkhoff, Wipperfuerth, all of Fed. Rep. of Germany

[73] Assignee: Patent Treuhand Gesellschaft fur Elektrische Gluhlampen m.b.H., Munich, Fed. Rep. of Germany

[21] Appl. No.: 661,593

[22] Filed: Feb. 26, 1991

[30] Foreign Application Priority Data

| | | | |
|---|---|---|---|
| Mar. 15, 1990 | [DE] | Fed. Rep. of Germany | 4008334 |
| Mar. 15, 1990 | [DE] | Fed. Rep. of Germany | 4008365 |
| Mar. 15, 1990 | [DE] | Fed. Rep. of Germany | 4008367 |
| Mar. 15, 1990 | [JP] | Japan | 4008337 |
| Sep. 24, 1990 | [DE] | Fed. Rep. of Germany | 9013457[U] |

[51] Int. Cl.[5] ..... H01K 1/50; H01K 1/18

[52] U.S. Cl. ..... 313/579; 313/273; 313/274; 313/279; 313/316

[58] Field of Search ..... 313/579, 273, 274, 279, 313/316

[56] References Cited

U.S. PATENT DOCUMENTS

| | | | |
|---|---|---|---|
| 2,042,963 | 6/1936 | Rentschler et al. | 313/273 |
| 3,195,001 | 7/1965 | Hodge | 313/274 |
| 3,764,845 | 10/1973 | De Fraeye | 313/279 |
| 3,840,953 | 10/1974 | Martin | 313/271 |
| 3,983,441 | 9/1976 | Northrup | 313/273 |
| 4,096,405 | 6/1978 | Goto | 313/273 |
| 4,570,104 | 2/1988 | Janseen et al. | 313/331 |
| 4,812,710 | 3/1989 | Klam et al. | 313/273 |
| 4,876,482 | 10/1989 | Stadler | 313/579 |
| 5,045,748 | 9/1991 | Ahlgren et al. | 313/579 |

FOREIGN PATENT DOCUMENTS

| | | | |
|---|---|---|---|
| 0143917 | 6/1985 | European Pat. Off. . | |
| 0173995 | 3/1986 | European Pat. Off. . | |
| 1952467 | 12/1966 | Fed. Rep. of Germany . | |
| 459316 | 11/1913 | France . | |
| 1147140 | 4/1969 | United Kingdom . | |
| 1435979 | 5/1976 | United Kingdom | 313/279 |

*Primary Examiner*—Donald J. Yusko
*Assistant Examiner*—Ashok Patel
*Attorney, Agent, or Firm*—Frishauf, Holtz, Goodman & Woodward

[57] ABSTRACT

To support a filament, or filament structure, in a halogen incandescent lamp, which may have a V or U filament, a straight filament, or be of the lumiline type, support ribs are placed within the lamp, which support ribs are formed from the lamp bulb material itself, by deforming the lamp bulb after local softening, for example by punches or by applying a vacuum, to provide interiorly extending, essentially tubular ribs. The tubular ribs may have circular or oval cross section, and can be placed to engage the filament to, for example, pinch the filament therebetween. In the pinching regions, the filament preferably is straight or only single-coiled and may be supported by a core pin.

47 Claims, 23 Drawing Sheets

FIG. 18
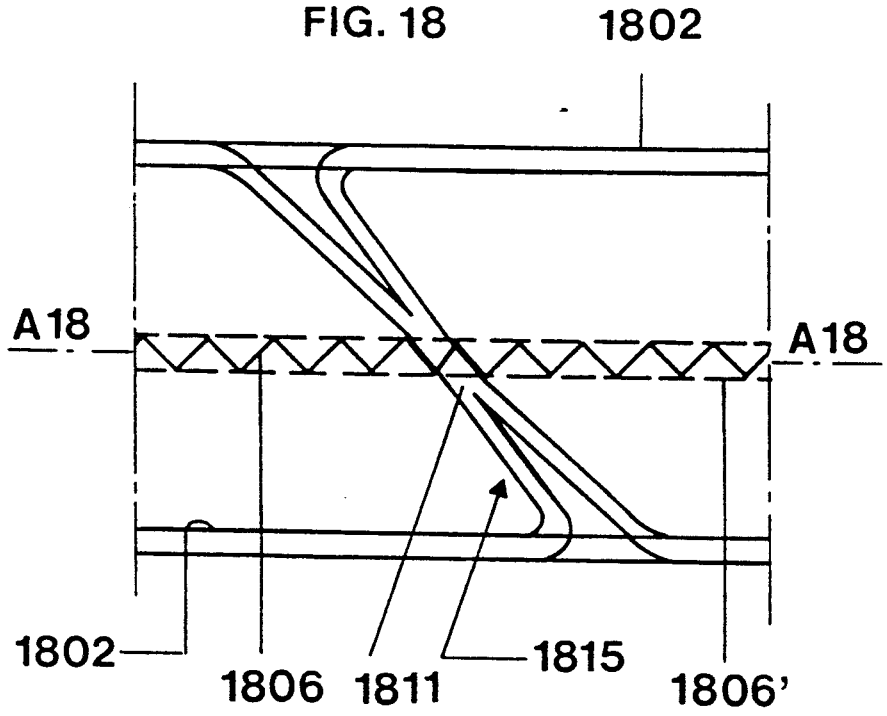
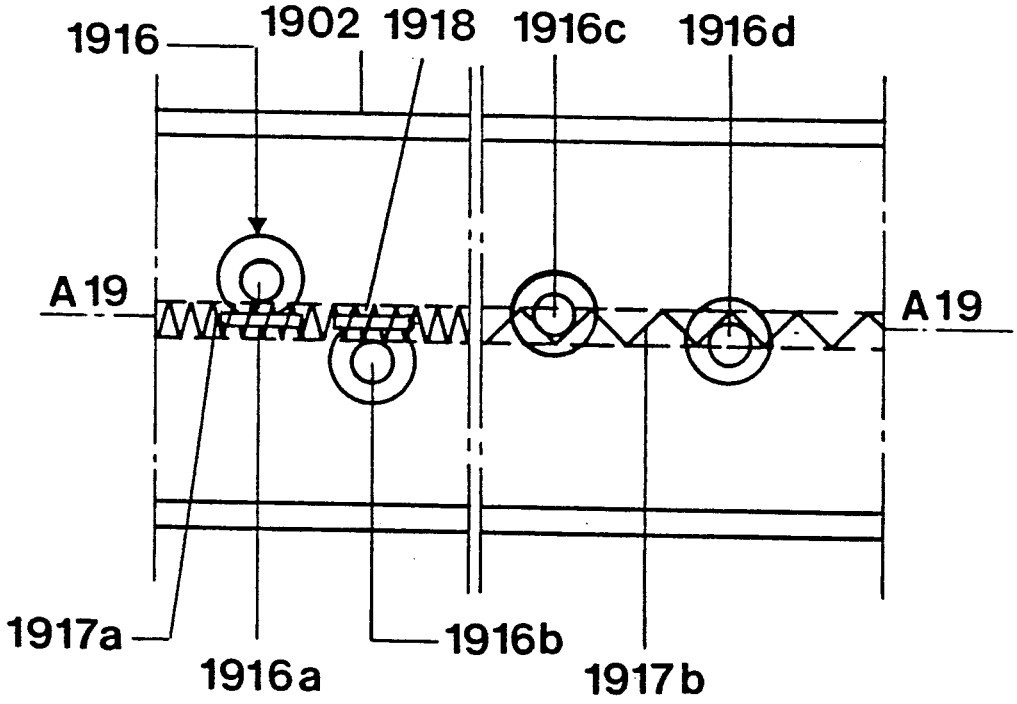
FIG. 19

HALOGEN INCANDESCENT LAMP, PARTICULARLY FOR OPERATION FROM POWER NETWORKS, AND METHOD OF ITS MANUFACTURE

Reference to related patents, the disclosures of which are hereby incorporated by reference:

U.S. Pat. No. 4,876,482, Stadler, assigned to the assignee of the present application;

U.S. Pat. No. 3,840,953, Martin.

Reference to related publications:

European Patent 0 143 917, Blumberg et al, assigned to the assignee of the present application;

Published European Patent Application 0 173 995, Westlund et al;

German Utility Model GM 19 52 467, Schmidt.

FIELD OF THE INVENTION

The present invention relates to electric lamps, and more particularly to halogen incandescent lamps intended for general service use and for connection to a power network, for example of 110 V, 60 Hz, or 220 V, 50 Hz nominal network voltages, and especially to support arrangements for the filaments of the lamps. The lamps may be single-ended or double-ended, and may use single-sided or double-sided pinch or press seals.

BACKGROUND

Halogen incandescent lamps, for example of the type described in the referenced U.S. Pat. No. 4,876,482, Stadler, often use a cross support element, typically of quartz glass, to retain the current lead-ins and support wires, if desired. The referenced European Patent Application 0 173, 995, Westlund et al, describes a single-ended lamp whcih does not use such a cross bar. The filament is retained only by a support wire which is melted-in together with the connecting foils in a pinch or press seal of the lamp. A lamp of this type, when designed for power network voltage, requires a filament having a relatively high resistance, and consequently of substantial length. The filament, to obtain this length, is bent into two luminescent arms, so that the general shape of the filament is approximately inverted-V shaped or inverted-U shaped.

It has been found, in operation, that the concept of the design of the aforementioned European patent application has some disadvantages. These lamps are sensitive to shocks and vibrations. If the lamp is subjected to a shock while it is lit, the two arms of the filament can touch each other. The portions of the filament which still have current flowing therethrough, thus burn out due to overloading. This is due to the application of the full network voltage over then only a fraction of the length of the filament. Usually, the engagement is about midway between the length of the filament legs, so that only half the normal filament resistance is present, causing burn-out and hence lamp failure.

If the lamp is operated in a horizontal position, the filament, due to sagging upon heating, can touch the interior of the bulb wall. The free length of the filament arms is comparatively long. Some hang-through or sag of the filament cannot be avoided; a typical hang-through is about 10%. Any contact of the filament with the lamp bulb causes blackening thereof and furthermore reduces the lifetime of the lamp.

Various types of holders for the filament have been proposed. For example, the referenced German Utility Model 19 52 467, Schmidt, describes a halogen incandescent lamp, particularly suitable for photographic use, which has a holder for a generally U-shaped filament, formed by a glass rod or glass tube which has at the end remote from the base one or more hooks to hold the filament melted therein. The filament itself is short, since a focussable light source is to be provided. The danger of engagement of the filament portions against each other upon shock or vibration, therefore, is low. The glass tube or glass rod is introduced into the pinch seal of the bulb and so positioned that a portion thereof is within the pinch seal, and coupled to the respective supply leads from the filament. Such a construction, at first glance, may also be suitable for general service halogen incandescent lamps. Yet, the requirements placed on service lamps for general illumination differ substantially from those of photo flood lamps, particularly with respect to lifetime and rated power. Price, also, is a factor. In photo lamps, the stability of the filaments is higher due to the usually greater diameter of the filament wires. Photo lamps, also, can be handled carefully since they are used only in specific controlled environments.

Glass rods or glass tubes located within halogen incandescent lamps of the type suitable in the photo lamp field hve the tendency to blacken during the desired lifetime of a general service lamp, which is in the order of about 2000 hours. Further, due to the high temperature, for the long period of time, the tubes may devitrify. Blackening and devitrification indirectly lead to premature lamp failure. In photo lamps, which have a lifetime in the order of about 50 hours, these effects are of minor importance.

Lamps constructed in accordance with the aforementioned referenced U.S. Pat. No. 4,876,482, Stadler, operate well; yet, assembly of the mount, together with the cross bar, is costly, since a number of individual elements must be assembled and properly positioned. The lamps, also, are relatively long.

U.S. Pat. No. 3,840,953 is another illustration of a halogen incandescent lamp utilizing a cross element or bridge of quartz into which the lead-in wires for the filament are melt-connected, together with an auxiliary support wire, of tungsten, to support the filament intermediate its length.

Lamps using an exceedingly long filament, such as lumiline lamps, also known as T or tubular lamps, require support along the length of the elongated filament. European Patent 0 143 917, Blumberg et al, assigned to the assignee of the present application, illustrates a lamp of this type having an elongated axial light emitting filament. If this lamp is operated horizontally, the long filament may sag through and touch the inner wall of the elongated tubular bulb. To prevent that, a plurality of spiral or ring-shaped filament support wires are provided, engaging the inner wall of the bulb and supporting the filament intermediate its length. The bulb wall is formed with small depressions to retain the wire holders for the filament.

Assembly of such lumiline bulb together with the filament holding wire spiral is complex and expensive, particularly if the spirals have to be snapped into their holding projections, formed internally by depressing the outer bulb at selected positions. For a standard lumiline lamp, about four such holders are required, which increases the cost of materials and assembly. Manufacture of a filament with holders therefor also is complex and expensive. To prevent damage to the filament, for example by deformation, the filaments msut be separated from one another, then the holder rings applied thereto, and separately handled and assembled. The further manufacture of the lamp, thus, becomes uneconomical and cannot be easily automated.

THE INVENTION

It is an object to provide a halogen cycle incandescent lamp, especially a quartz halogen lamp, which is suitable for general service use, connectable directly to a power network of customary network supply voltages, which has long lifetime, is easily and inexpensively made, and, especially, can be made on automatic machinery; the lamp should be tolerant of vibrations and shocks.

Briefly, the filament is supported and/or separated interally of the lamp by at least one rib or protuberance means of the same transparent material form which the bulb is made, the ribe or protuberance means made form two halves being deformed from the bulb, to extend inside the bulb toward the bulb axis, from two spaced regions, for example from opposite regions of the wall of the bulb. These halves of the protuberance means or rib halves which extend close to the axis or middle plane of the lamp will have essentially tubular shape or even strip shape, can extend towards each other to meat in a melt connection, or merely touch each other, thereby forming a rib made from two halves.

The rib or protuberance elements, made from the glass bulb, can be easily manufactured by locally softening the wall of the bulb, and placing two punch or jaw elements against the softened region, to deform them to form the ribs. Alternatively, the softened regions can be drawn towards each other by applying a vacuum within the bulb.

The concept of the present invention departs from the customary constructions, in which it was intended to simplify the mount and support elements therefor, and to arrange them in such a manner that they can be made by automatic machinery. Rather than changing the support wires and elements previously used for the filaments, the present invention permits elimination of such support structures, at least for many types of lamps. In some lamps, previously used support structures can be combined with the ribs or tube elements which are deformed from the wall of the bulb, permitting substantially simplified support constructions.

Previous attempts to utilize separate glass elements introduced into the bulbs did not lead to success. It has been found that such other elements are incapable of withstanding the high temperature within a halogen cycle tungsten incandescent lamp, so that the desired long lifetime, in the order of 2000 hours rated life, could not be obtained.

Surprisingly, and entirely unexpectedly, it has been found that ribs or tubes which are formed of the bulb material itself have a much greater durability with respect to high temperature effects. It is believed that this technology provides for additional cooling from the outside and heat conduction towards the bulb surface, which counteracts deterioration of the glass ribs made of the bulb material.

The filament itself may be made in various ways, for example in inverted U or V shape, that is, formed of two essentially straight legs with a connecting portion, or it may be axially arranged within the bulb. More than two legs may be used. If the lamp is a lumiline or T lamp, the filament can be straight and elongated.

In accordance with a feature of the invention, the filament is U or V-shaped, and the connecting portion or base of the U, or the region adjacent the apex of V, is positioned by a glass rib. The glass rib can hold the filament mechanically, or in a pinch or press connnection. Further glass ribs can be located along the legs of the filament, selectively placed to form a mechanical separating rib or ridge, or also formed as a pinch or press seal engaging legs intermediate its length. Such a pinch or press connection provides for a tight junction between the pinch or press of the internally extending rib with the filament, and leads to excellent heat conduction away from the particular portion of the filament, thus prevent blackening and devitrification of the glass rib. Further, the point at which the glass rib engages the filament does not provide a bright spot since, a that location, the filament practically will not emit light, that is to say, its contribution to the emission of light is negligible.

Preferably, the filament is subdivided between a group of luminescent or incandescent portions. The non-luminescent portions or, rather, the not brightly lit portions, form the connecting sections of the filament. One such section may, for example, be the apex region of the V or the base region of the U. For example, the filament can be a double-coiled or coiled-coil filament; in the region of engagement with the internally projecting ribs, the filament can be only single-coiled or not coiled at all, i.e. straight; alternatively, a reinforcing pin can be inserted within the coiled region where specific illumination is not needed, but the filament portion is engaged by the internally projecting glass rib.

The glass rib can be formed in various ways, for example as a solid rod. That, however, is difficult to make and not entirely satisfactory from a rib cooling point of view. In accordance with a preferred feature of the invention, the rib is hollow, e.g. having a circular or oval cross section; it can also be formed, for example, in form of an elongated flattened projection. This further improves the cooling since the heat dissipating surface will be larger than the portion of the filament which applies the heat to the rib.

The lamp can be operated in various positions, that is, vertically or horizontally. Optimum operating conditions, upon horizontal position of the lamp is obtained if a plurality of glass ribs are used, suitably distributed along the length of the bulb; this is particularly important for lumiline lamps.

Basically, two alternatives for the support effect of the ribs are possible.

(1) Mechanical holding, in which the incandescent element, that is, the filament, snugly engages the ribs. As a modification, the ribs may be surrounded by a winding or coiling of the filament, and, preferably, the pitch or distance between windings of the secondary coiling of the filament is selected within the region of the rib to be so high that it matches the outer diameter of the rib. In accordance with a particularly preferred feature, the filament is short-circuited in the region of the rib by a core pin, thus substantially decreasing its temperature.

(2) The rib, preferably in tubular form, supports the filament by surrounding a portion of the filament, similar to the engagement of a conductor in a pinch or press seal. In other words, a portion of the light emitting element of the lamp is press-sealed between two halves of the rib, extending, each, from an opposite wall of the bulb. In such a connection, the temperature of the glass rib should not exceed a limiting value which, in quartz glass, is at about 800°–900° C., and in hard glass in the order of about 600° C.; otherwise, tensions within the glass may arise or the glass rib may become soft. Preferably, the thickness of the rib in the region of the pinch connection exceeds the outer diameter of the filament by at least 30%, and preferably by 100%.

The ribs can be placed in various ways and, for example, to form separating structures between parallel legs of a U or V filament.

Low power lamps, which normally operate at correspondingly low temperatures, for example lamps of 50 W or less, can use a continuous coiled-coil filament which is pinch-sealed in the glass ribs. Lamps of intermediate power, for example lamps in the order of 75 to 150 W, can use coiled-coil filaments which are subdivided into portions by single-coiled stretches which, again, are pinch-melted into the glass ribs. Higher powered lamps, that is, lamps of over 150 W, preferably use coiled-coil filaments which are subdivided into portions of straight or single coiled regions. These straight, non-coiled regions will have a substantially lower temperature than the coiled-coil portions. Additional cooling can be obtained by using core pins or elements, which are placed in the region of the ribs, and short-circuit portions of, for example, coiled regions, so that the temperature of the filament in the single wire region or coiled region is substantially reduced.

Of course, if single-coiled filaments are used, suitable arrangements of coiling and, respectively, straight portions, if desired, can be used, and appropriately supported by the glass ribs.

The regions of decreased temperature of the filament prevent blackening and devitrification of the ribs as well as of the bulb as a whole, which, otherwise, might lead to premature failure of the lamp. In general, the power density in the regions of lower temperature is substantially reduced. As well known, of course, heat losses are least in coiled-coil filaments.

Forming support ribs from the bulb itself permits simple holding of the filament; it is easily made. The dimensions of the ribs are so selected that the halogen cycle within the lamp bulb is not impaired. Typically, the inner diameter of the ribs, close to the axis of the lamp, is in the order of about ½ mm.

The ribs, typically tubular, are expanded towards the outside of the bulb in funnel-like shape. This gradual expansion from a narrow tube close to the axis of the lamp to an outer further expansion prevents formation of thin points or locations in the region of the transition to the wall of the bulb, which might decrease the capability of the bulb to resist shattering or explosion. The wall thickness remains essentially homogeneous.

In manufacture of the lamp, the ribs are preferably formed before the end of the bulb is pinch-sealed to secure the connections and external leads of the lamp. The filament, first, is suitably tensioned by a jig and introduced into the bulb, which is still open at one end. The bulb is then heated in the region of the future ribs by burners and then deformed by punches which engage from opposite directions against the softened bulb portions. This technology has the substantial advantage that the position of the filament does not have to be re-adjusted later and that, further, the filament cannot change position after having once been located in position by the deformed ribs.

Each rib is easily made by forming the punches as conically converging round rods which deform the bulb to provide two hollow, essentially funnel-shaped fingers of glass, depressed from the wall of the bulb, which fingers of glass, in this specification, are herein referred to as the "ribs". These glass fingers, preferably, touch each other or engage each other in a plane including the axis of the lamp, or close thereto. The diameter of the funnel at the outside, where it meets the wall of the bulb, and the degree of narrowing towards the axis of the lamp, depends on the size of the heated zone at the wall of the bulb. The absolute value of the rib diameter, that is, the diameter of the hollow finger in the vicinity of the axis of the lamp, depends, of course, on the dimensions of the punch element. A junction region between the oppositely positioned fingers of glass is preferably formed by a solid end plug. This closed end or plug portion on each one of the fingers of glass will, at the outside thereof, form a junction or connection or seam with the opposite finger. It can remain, which substantially simplifies manufacture.

In accordance with a preferred feature of the invention, the pinch method of forming the rib is so carried out that the filament will be exactly between the two ribs and is located in position by the formation of the end plug. Ribs with oval cross section are made with stamps or punches having an oval or rectangular profile. The rectangular profile or the oval profile may also be formed, at least in part, with longitudinally extending grooves, flutes or furrows.

Lamps which are known to be used extensively in horizontal position, for example lumiline lamps, may use internal ribs of heavier size. A suitable size for such ribs is, for example, a diameter of between 0.5 to 2 mm, expanding at the funnel-shaped end close to the wall of the bulb to twice to four times that diameter.

The ribs need not diverge funnel-like, with essentially straight conical surfaces; the walls of the ribs can be convexly curved or concavely curved. Formation of the walls with bubble shape or concave curvature can also be made without application of punches. This is particularly suitable, for example, for lumiline lamps. The filament is inserted in the lamp and the filament can be pinch or press-sealed in position; the bulb evacuation tube or stub should not yet be tipped off, and the fill not yet inserted. Rather, a vacuum is placed against the stub to cause a vacuum in the millibar region while, simultaneously, the wall of the bulb is heated at point locations from opposite sides, for example by a gas burner. This technology is particularly suitable for bulbs of small inner diameter, for example of 6 mm or less, and also suitable for filaments having long connecting portions, for example of 5 mm or more, especially suitable for network voltages of nominally 110 V. The walls of the glass will collapse under the influence of the vacuum, resulting in a gentle melting-in or holding of the filament or, rather, of the connecting portion and/or a core wire; deformation of the filament due to the mechanical force of punches pressing the glass together is effectively eliminated.

Of course, application of punches can be used in combination with evacuation of the bulb, so that a combination of the two methods can be used; by applying a vacuum, less punching or press force need be used, so that gentle clamping of the filament by the glass rib is obtained. For separating the filament without fixing it, the rib can have the form of a strip.

Making the rib in the form of a hollow element has the advantage of improved cooling, since the heat radiating surface is substantially increased. Merely providing a rib, which does not flare out, is sufficient to separate and/or support the filament, although the cooling effect is enhanced by flaring the ribs towards the wall of the lamp.

Single-ended lamps can be placed in any position; if the ribs are only used to separate the filament legs, and the lamps are placed horizontally, they should, preferably, be so located that a plane passing through the legs of the filament is horizontal, rather than vertical. Such a lamp having relatively short luminous incandescent arms, for example in the order of about 10 mm long, may be self-stabilizing within their windings; such filaments are usually used with lamps of, for example, 110 V networks. To be free from such restriction, and especially if the network voltage is 220 V, and the arms of the filaments are longer, for example about 15 mm, a plurality of tubular ribs are preferably used, which hold the respective incandescent arms in position by supporting and fixing the filament, and thus take over the well known intermediate holding or supporting function. One such rib for each portion of the filament, that is, for each filament leg, is suitable.

The lamps have a lifetime which substantially exceeds that of service-type incandescent lamps, that is, a rated life in the order of about 2000 hours. They are simple to construct since no additional cross elements or bridges are needed. The tube diameter can be reduced from previously known lengths by, for example, 2–4 mm, as well as bulb length by, for example, 7 mm. Due to the smaller internal volume of the bulb, less fill material is used.

The lamps are particularly suitable for a direct connection to network voltages, which are voltages in the region of between 80 V to 250 V. Typical power ratings are from 15 to 500 W, although the lamps can be used with much higher power ratings, up to for example 2000 W. For general service illumination, the lamp can be surrounded by an outer bulb. The lamp, since it is compact, is also eminently suitable for use in reflectors, for example in PAR lamps, lamps having dichroic reflectors and the like, and can be based, as desired, with screw or pin bases. Preferably, the filament for a service-type lamp is bent in inverted U form, and for reflector type lamps, it is axially aligned. For both single-ended lamps and lumiline lamps, the tube diameter can be reduced by about 20% with respect to prior lamps. For single-ended lamps, the length can be reduced up to 30% because structural elements in the vicinity of the pumping stub need not be used with U-shaped filaments, so that the entire structure is simple. For both single-ended and lumiline lamps, the bulb can be circular in diameter or oval; if an oval bulb is used, the ribs preferably extend along the shorter half axis towards each other so that the space to be bridged is a minimum. This reduces the decrease in wall thickness of the tubular ribs, to retain an essentially homogeneous wall thickness for the ribs. Tubular lamps made in accordance with the present invention may have power ratings, typically, of between 15 to 2000 W, where they can also be used for flood lights as well as for general service strip illumination.

Single-ended lamps having power ratings of between 15 to 500 W may use separating elements and supports for the filaments solely formed by the glass ribs. For those lamps, it may be desirable to combine the glass ribs in accordance with the present invention with additional support structures for the filament, which may be formed of metal, inserted into the bulb. If such a metal frame or support is used, it is preferably so arranged that one long leg extends along the bulb wall, and a second leg extends along an opposite bulb wall which, however, is substantially shorter. This unsymmetrical arrangement, especially when used with a filament of U shape, has an advantage over a symmetrical arrangement ad described, for example, in European Published Patent Application 0 173 995, Westlund et al, in that it does not have the tendency to tip about the lamp axis during insertion.

The filll for the bulb, typically, is a mixture of an inert gas of 80% Kr and 20% $N_2$, with a halogen additive of $CBrClF_2$; alternatively, the halogen additive may be $CH_2Br_2$. Other suitable halogen additives may be used, as well known. Typically, the quantity of the halogen additive may vary between 0.005 and 0.05%.

DRAWINGS

FIG. 1 is a side view of a halogen incandescent lamp with one support protuberance or support rib;

FIG. 2*a* is a side view of another embodiment of a halogen incandescent lamp illustrating a plurality of support ribs;

FIG. 2*b* is a view of FIG. 2*a*, rotated by 90°;

FIG. 3*a* is a detail view of a rib fixing a filament;

FIG. 3*b* is a detail view of an alternative construction of a rib fixing a filament;

FIG. 4*a* is a cross-sectional view taken along line IV—IV of FIG. 2*a;*

FIG. 4*b* is a cross-sectional view similar to FIG. 4*a*, illustrating another embodiment of the lamp and having an oval envelope;

Figure 7A:
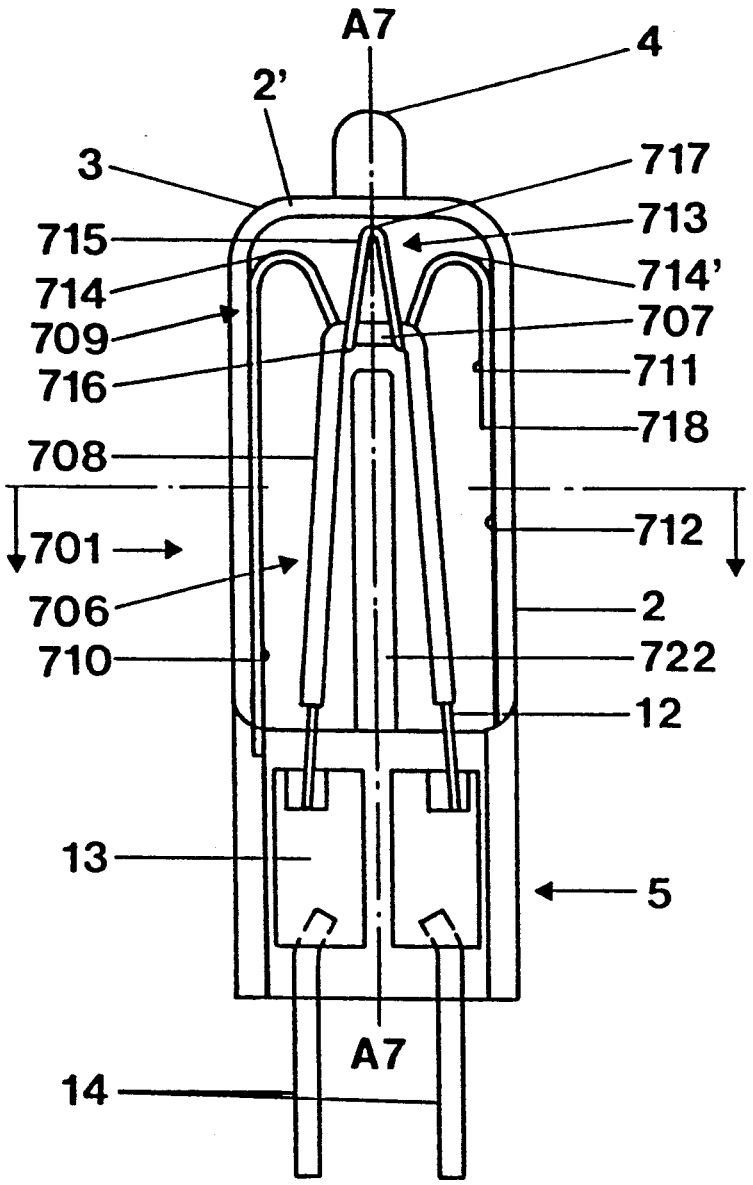
Figure 7B:
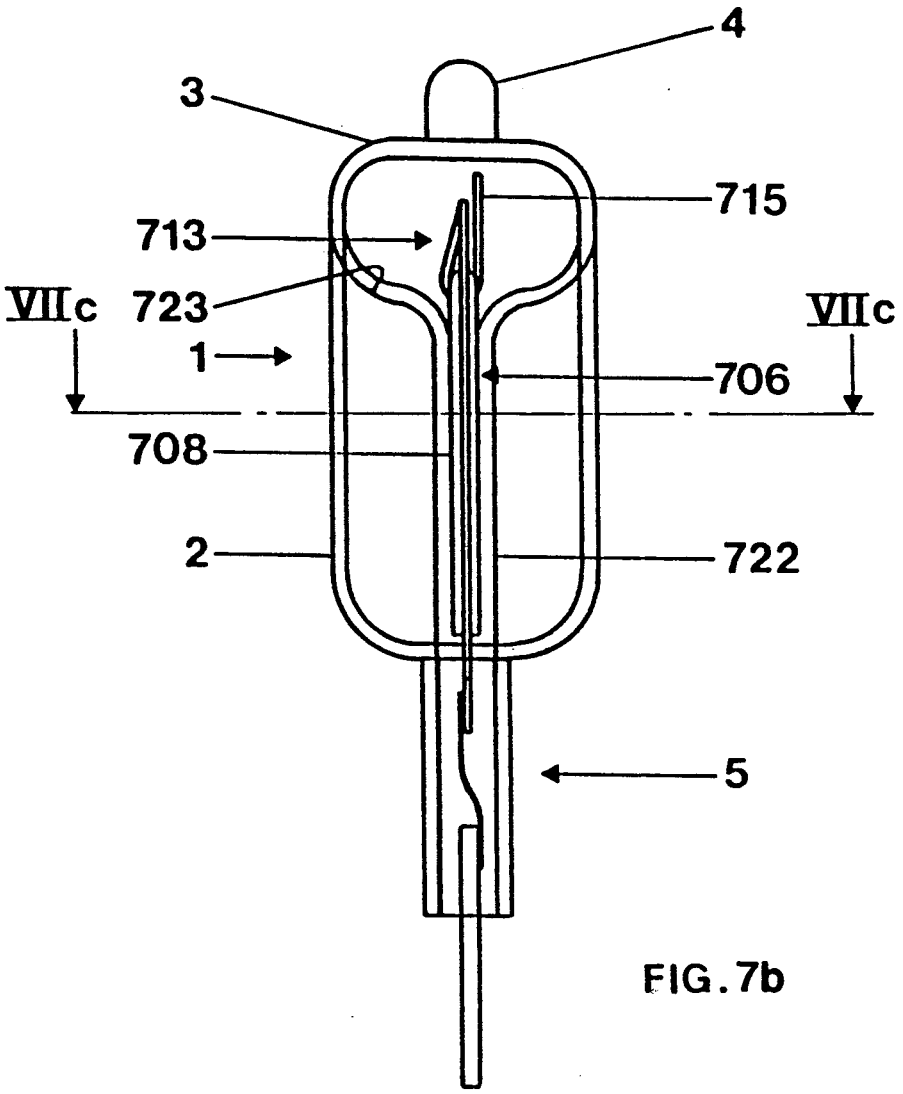
Figure 7C:
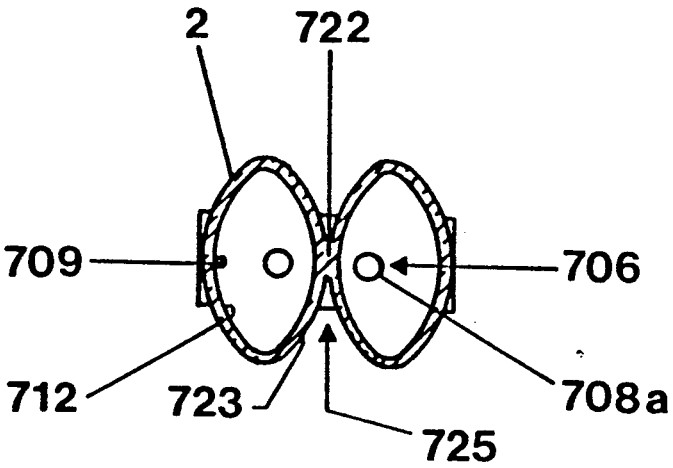

FIG. 7*a* is a lamp with a strip-like rib and a metal holder, and using the concept of the present invention, in side view;

FIG. 7*b* is the lamp of FIG. 7*a*, rotated by 90°;

FIG. 7*c* is a cross section of the lamp taken on line VIIc—VIIc of FIG. 7*b;*

Figure 8A:
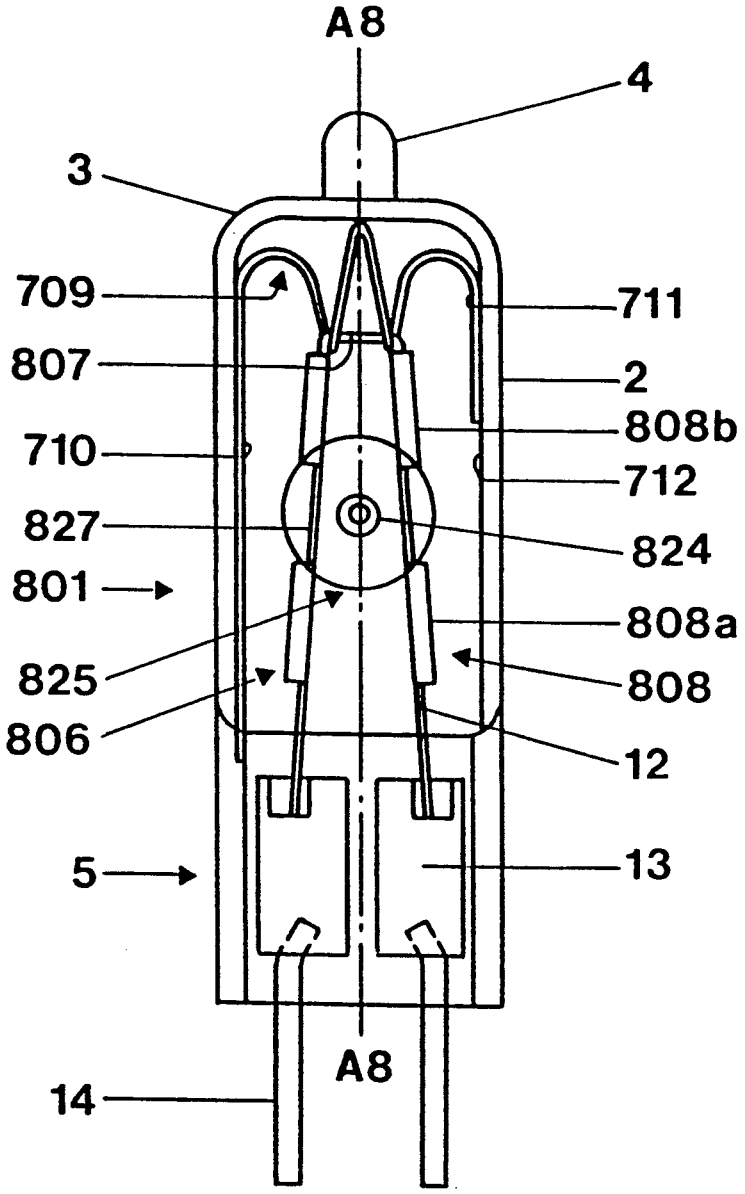
Figure 8B:
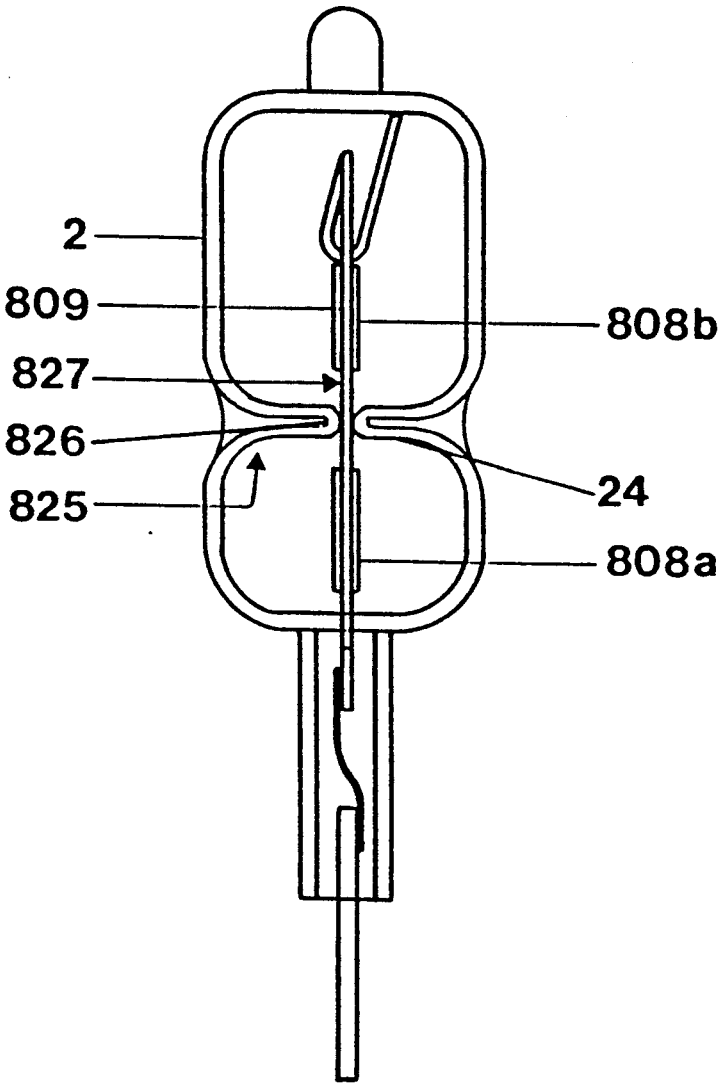
Figure 9A:
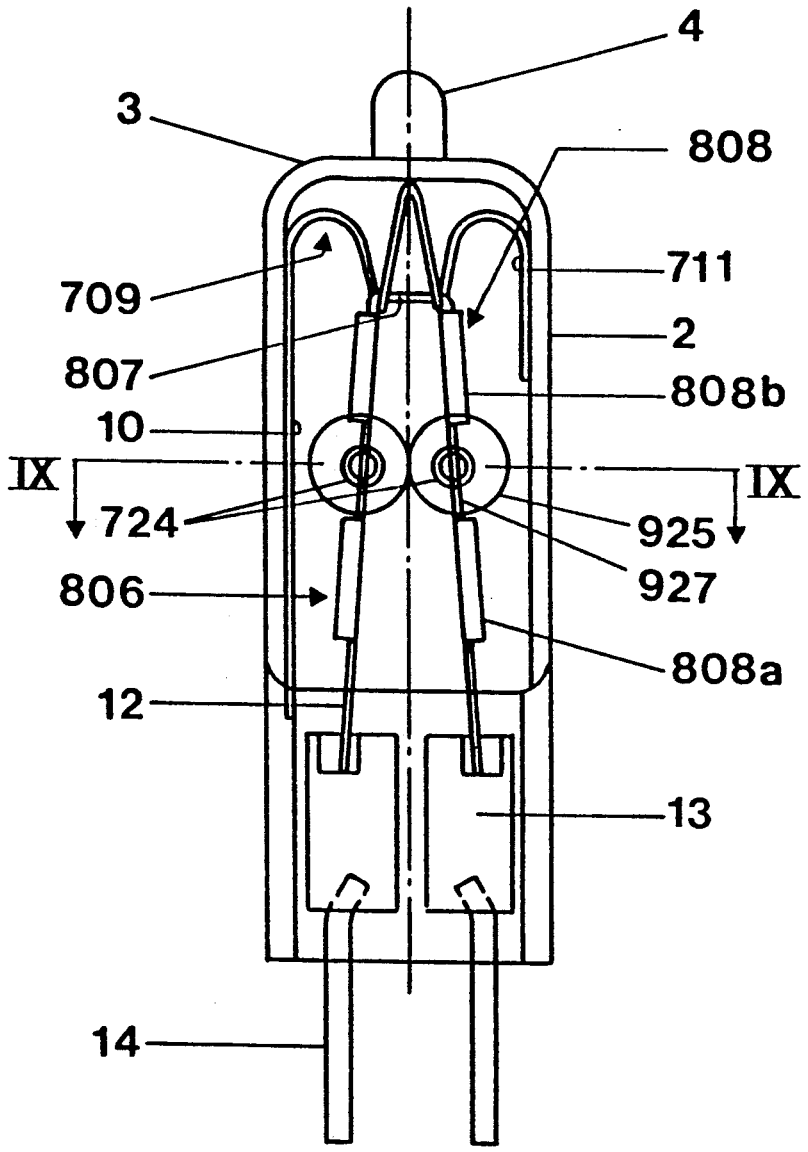
Figure 9B:
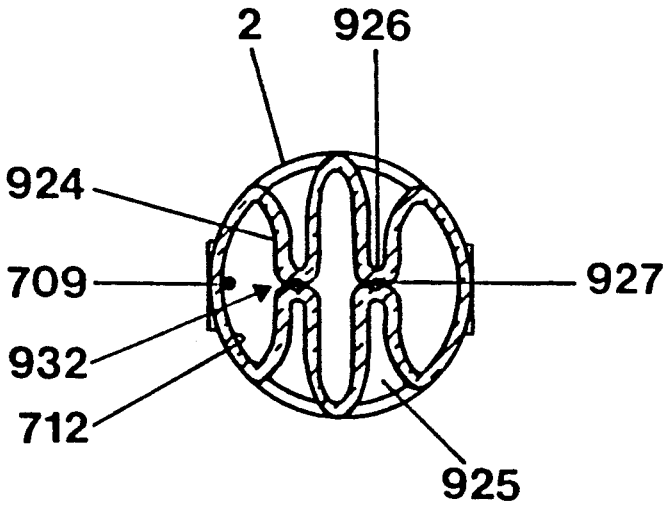
Figure 10:
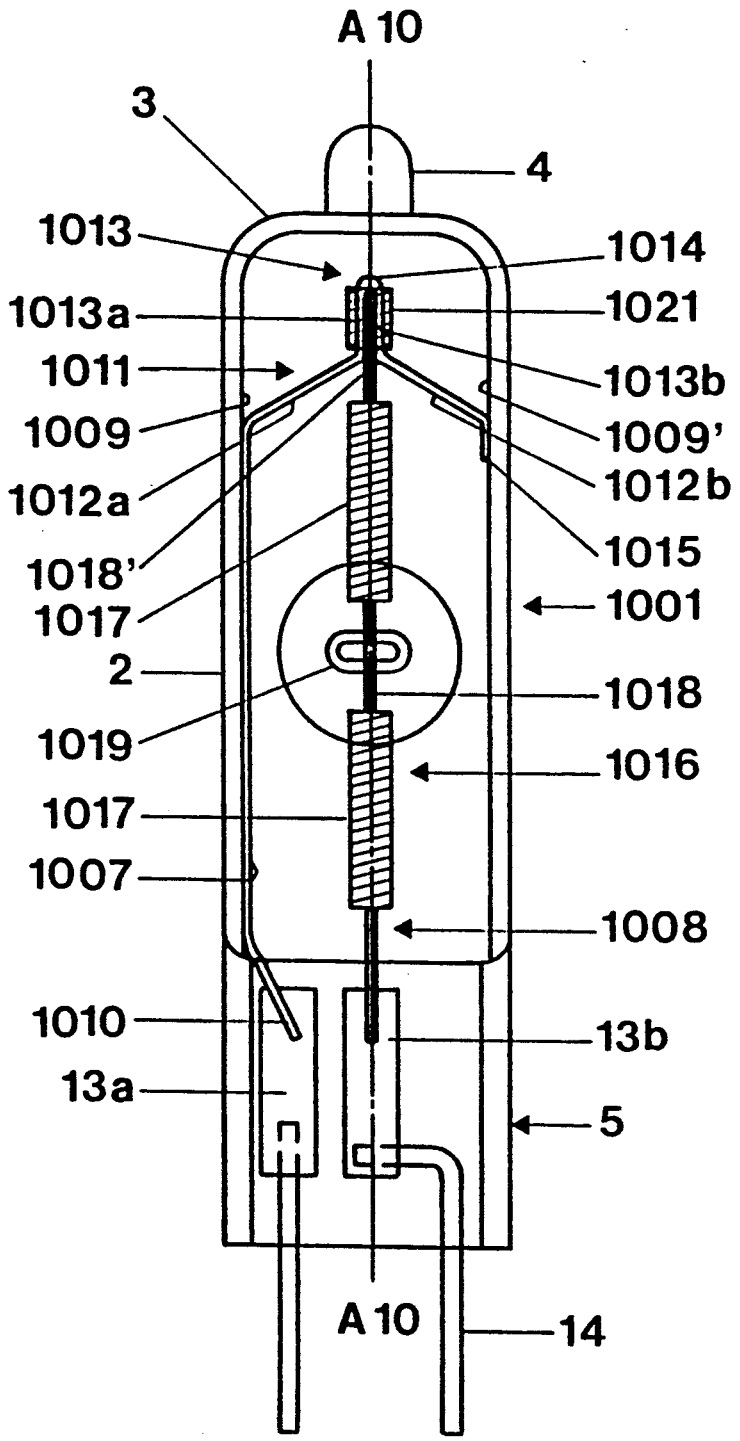
Figure 11:
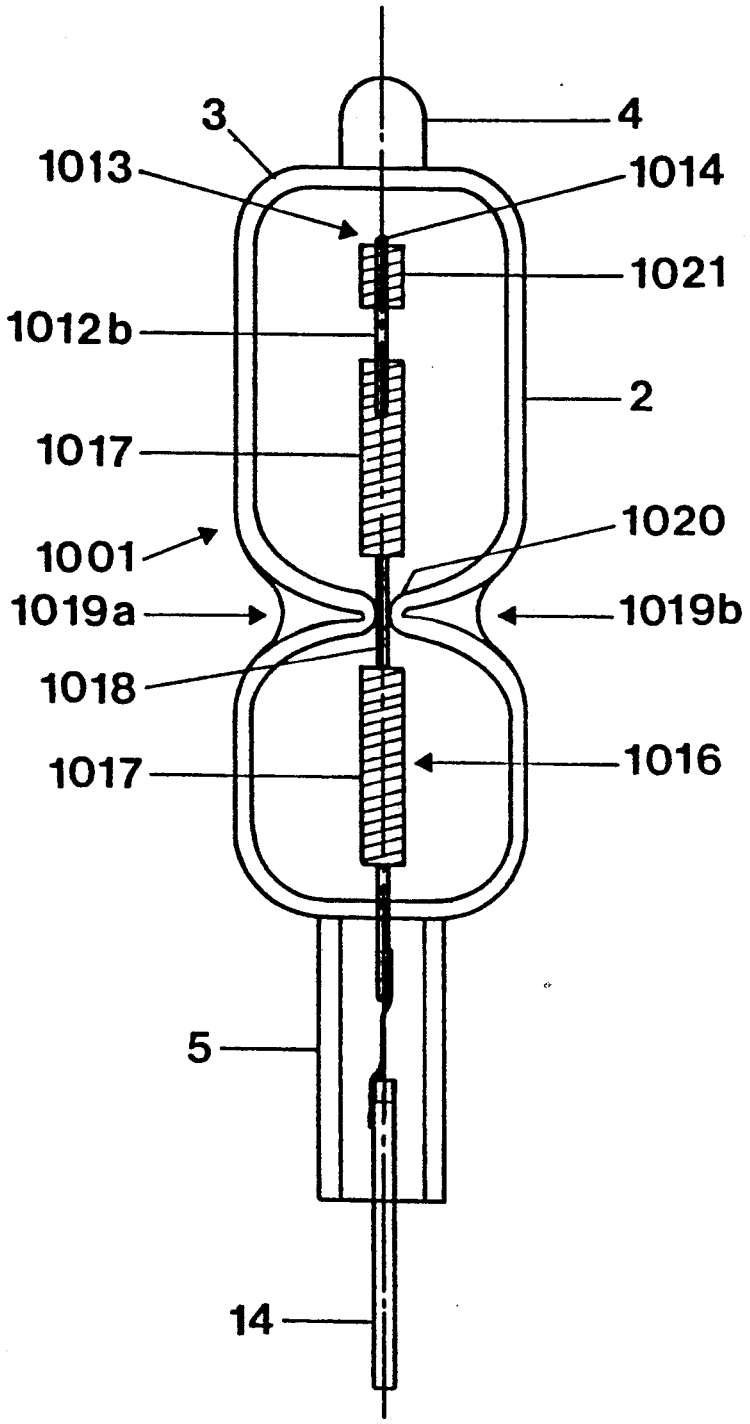
Figure 12:
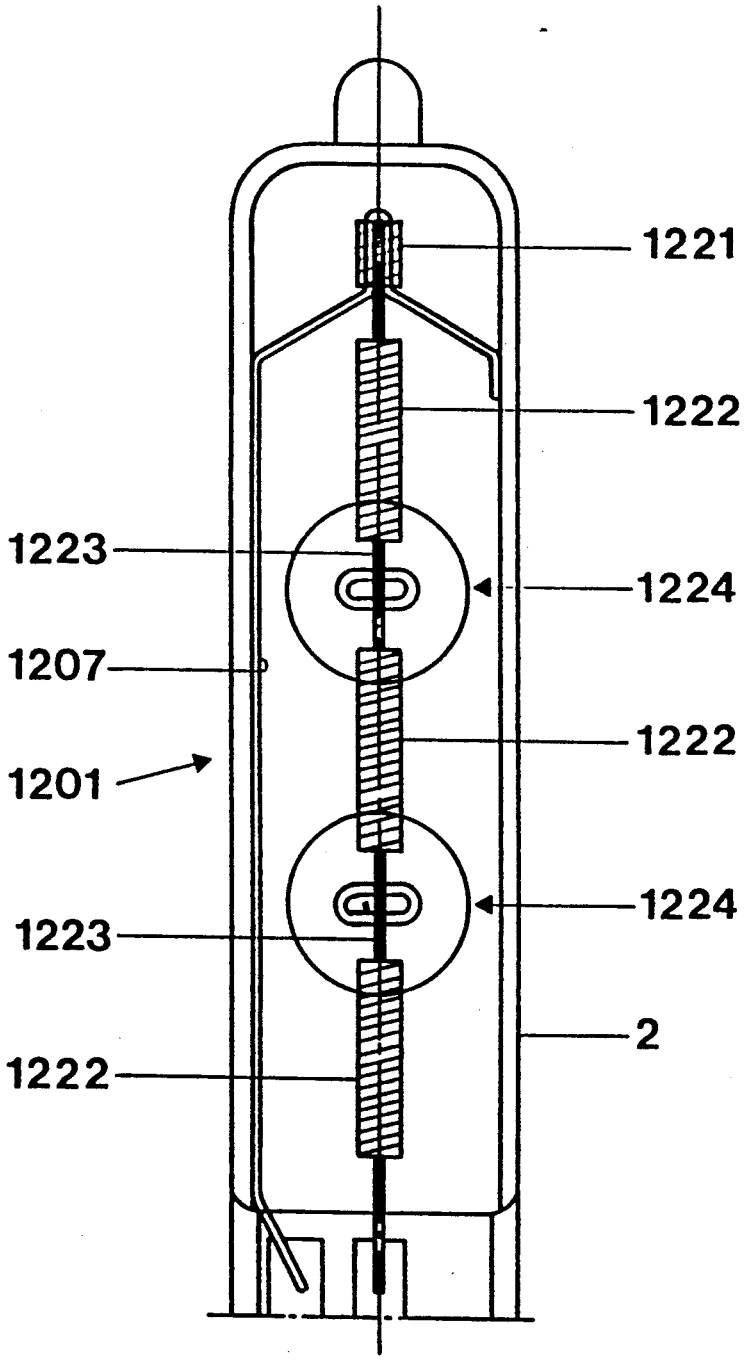
Figure 13:
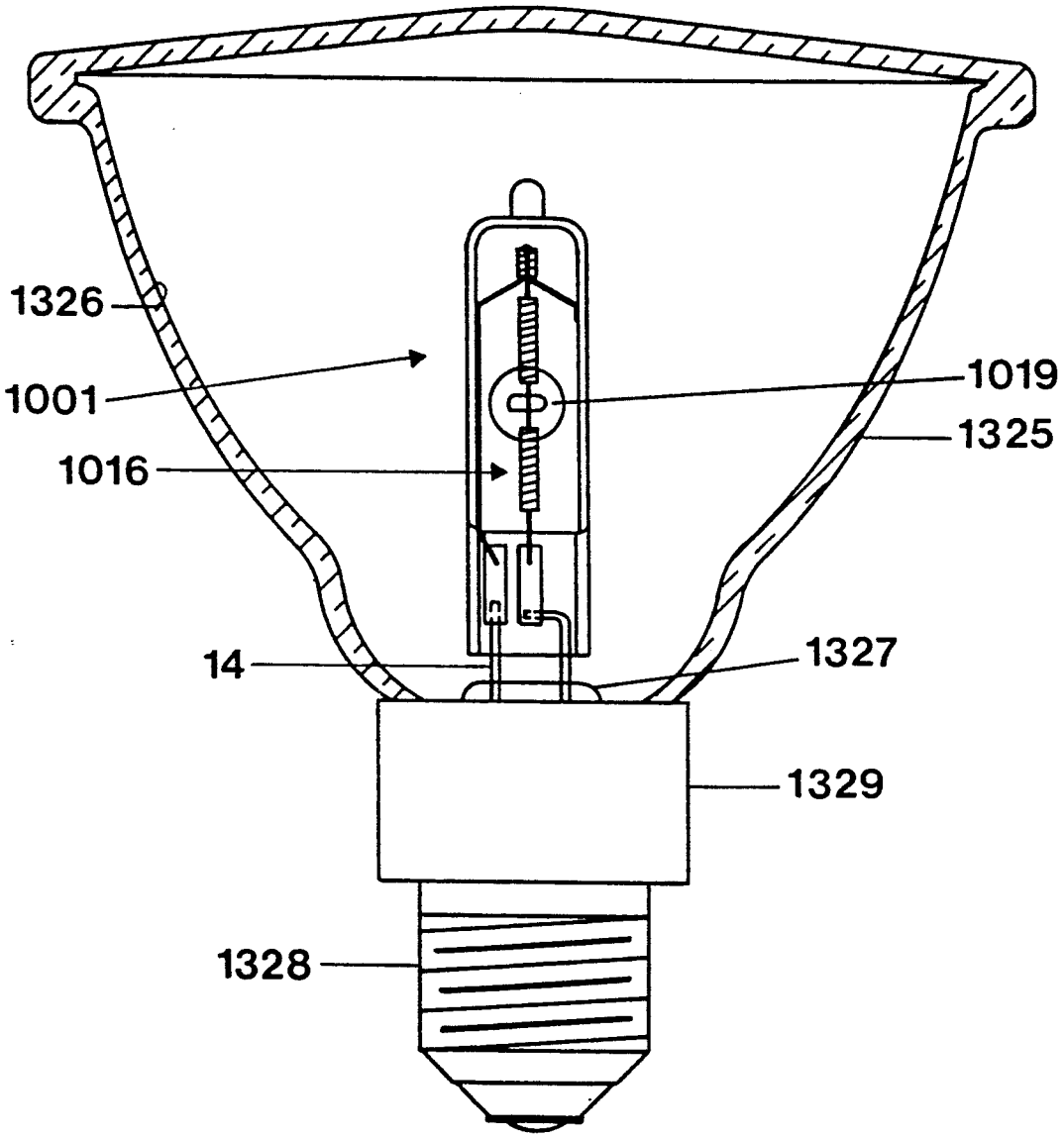
Figure 14A:
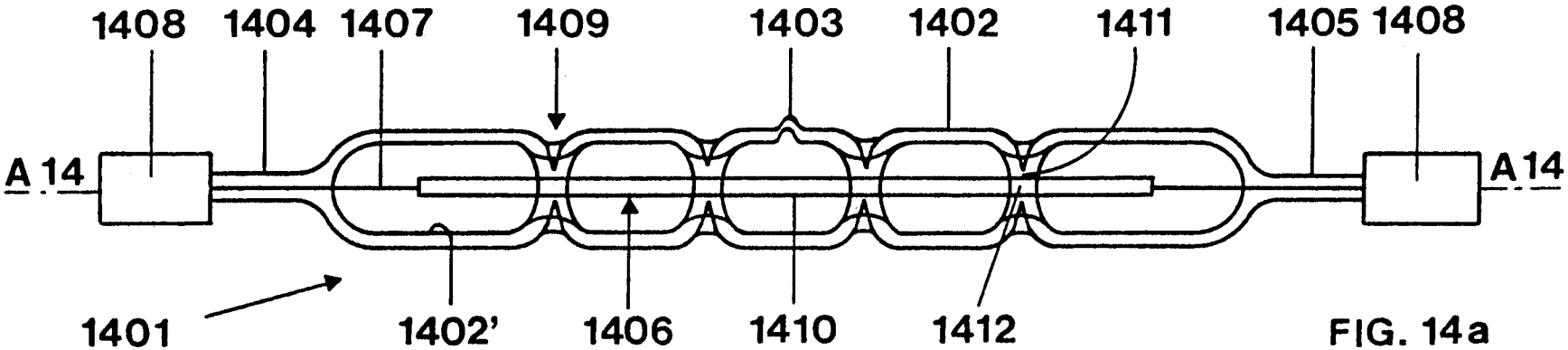
Figure 14B:
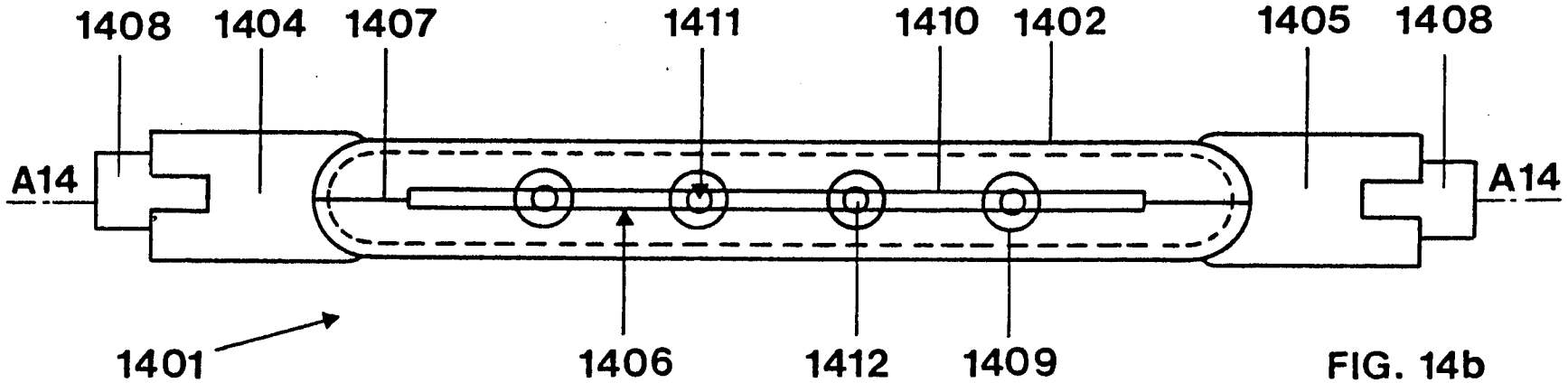
Figure 15:
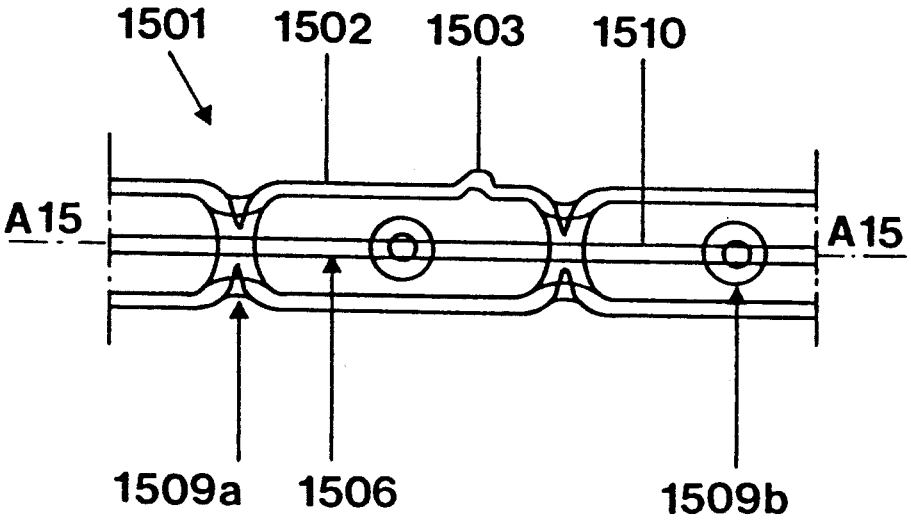
Figure 16:
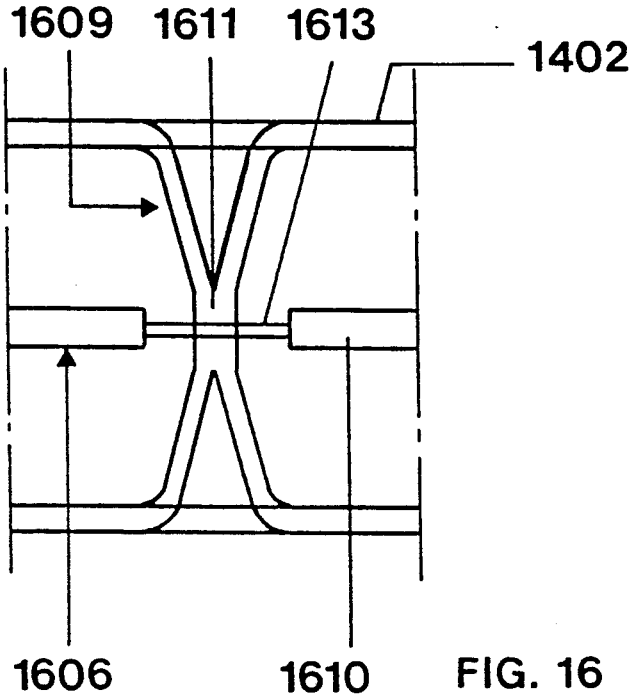

FIG. 8*a* illustrates another embodiment of a lamp in side view;

FIG. 8*b* is a view of the lamp of FIG. 8*a*, rotated by 90°;

FIG. 9*a* is yet another embodiment of the lamp, in side view;

FIG. 9*b* is a cross section across the lamp of FIG. 9*a* along lines IX—IX;

FIG. 10 is another embodiment of the lamp with an internal holder structure, in side view, and having an elongated filament;

FIG. 11 is the lamp of FIG. 10, in side view, and rotated 90° with respect to FIG. 10;

FIG. 12 is another embodiment of an elongated lamp with an elongated filament, in side view;

FIG. 13 is the lamp of FIG. 10 installed in a reflector to form a halogen PAR lamp;

FIG. 14*a* is a side view of a lumiline lamp utilizing the present invention;

FIG. 14*b* is a view of the lamp of FIG. 14*a*, rotated by 90°;

FIG. 15 is a fragmentary side view, similar to a portion of FIG. 14*b*, and illustrating another arrangement of ribs;

FIG. 16 is a detail view of a rib construction to support the filament of the lamp of FIG. 14*a* or FIG. 14*b;*

Figure 17A:
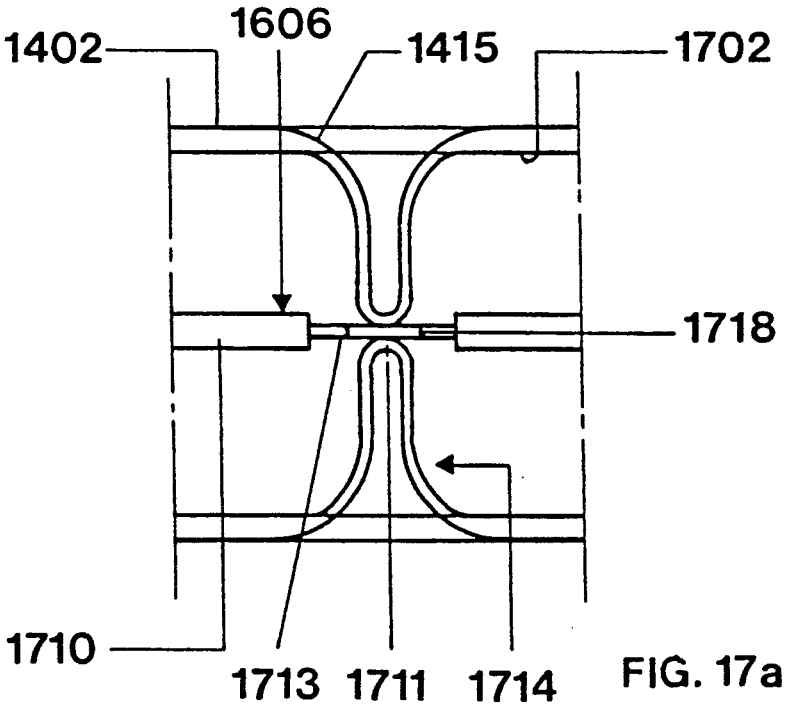
Figure 17B:
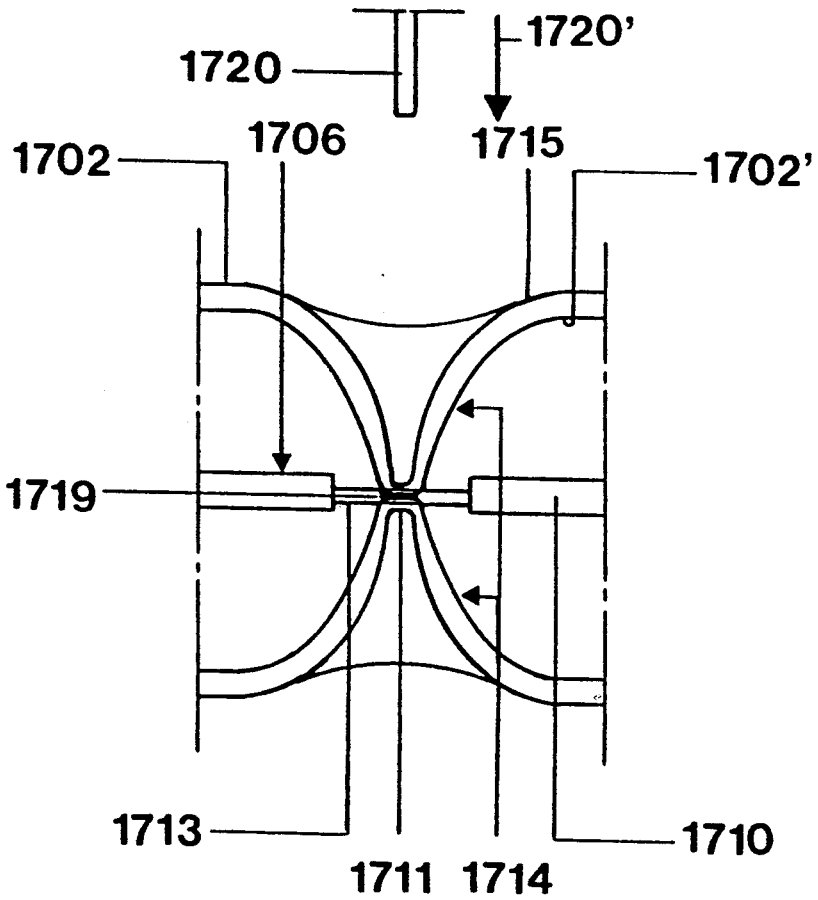
Figure 20:
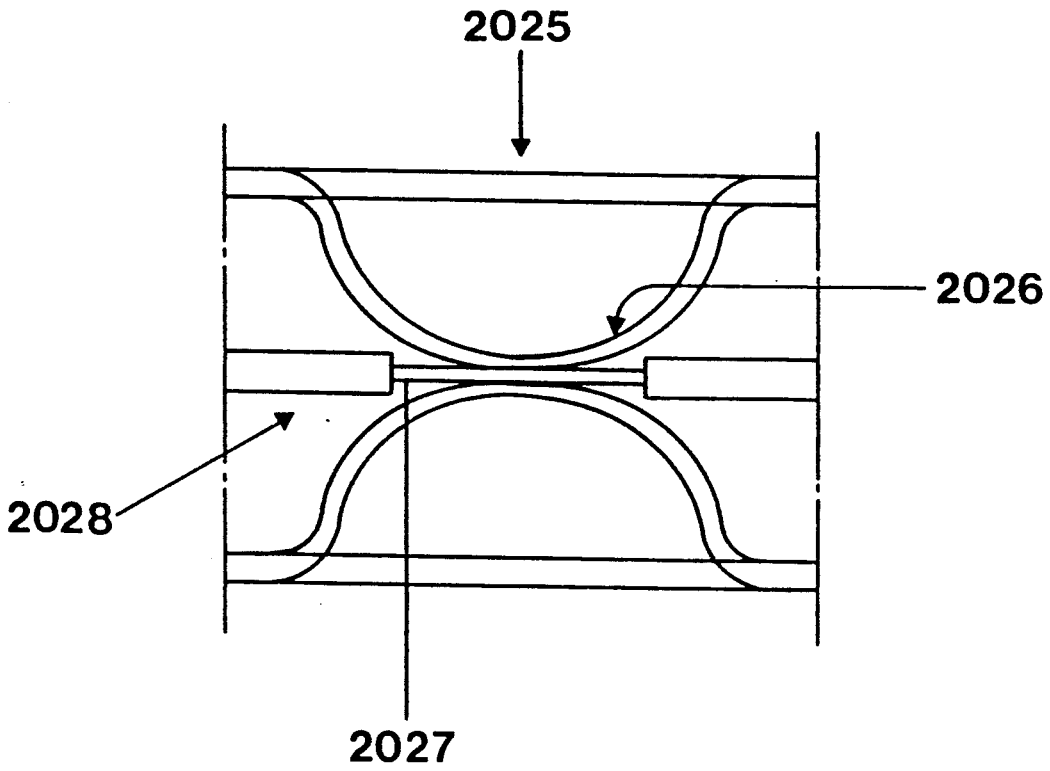

FIG. 17*a* is a detail view of a rib construction;

FIG. 17*b* is a detail view of a modified rib construction, and illustrating a deforming die used in the process of making the rib;

FIG. 18 shows another modified rib construction, particularly suitable for lumiline lamps;

FIG. 19 is a schematic view of another type of rib support particularly suitable for lumiline lamps; and FIG. 20 is a detail view of yet another form of rib construction of lumiline lamps.

DETAILED DESCRIPTION

Referring first to FIGS. 1 to 6: These lamps, generally, are suitable for example of from between 15 to 200 W, and intended, basically, for general service illumination. The lamp 1 is a 110 V, 200 W lamp, having a cylindrical bulb 2 of quartz glass, with an outer diameter of 12.5 mm, an inner diameter of 10.5 mm, with a tolerance of 0.8 mm. The overall length is about 35 mm. One end of the bulb 2 is formed with a rounded cap 3, having an exhaust and fill or pumping tip 4 at the end. The other end of the bulb 2 is closed off by a pinch seal 5. The interior volume of the bulb is 1.65 $cm^3$, and filled with a standard inert gas of crypton, nitrogen, and a suitable halide additive, for example 0.005% $CBrClF_2$.

A V bent element 6, which is a coiled-coil filament extends over approximately the entire inner length of the bulb. The apex of the V is rounded, to form a connecting portion 7, located in the vicinity of the cap 3. The two legs 8 of the V, which are the actual incandescent, light-emitting portions of the filament, are approximately 15 mm long and form the coiled-coil filament arms, extending from the connecting portion 7 to the pinch seal 5. In the region of the pinch seal, they diverge slightly outwardly. The two legs 8 are double-coiled; the connecting portion 7, however, is either single-coiled or uncoiled.

The filament legs 8 terminate in singly coiled portions or straight portions 12 which function as current supply leads. The current supply leads 12 are welded to sealing foils 13. The current supply leads 12 have an overall length of about 6 mm, and extend from the pinch seal 5 by about 1–2 mm into the bulb. This arrangement permits elimination of core pins, used in prior art lamps. The ends of the foils 13 are connected to terminal leads or connection pins 14, for example by welding, extending through the pinch seal 5 towards the outside of the bulb.

In accordance with a feature of the invention, the filament 6 is mechanically retained in the V-shaped position by a glass rib 9, supporting the inner portion of the rounded connection part 7. The rib 9 is formed as a glass tube, made of the material of the bulb, and extending transversely to the axis A1 of the lamp, and to the plane of the filament, throughout the inner diameter of the bulb. The glass tube or rib 9, in the vicinity of the lamp axis A1, has a diameter of about 1.2 mm. It diverges outwardly, funnel-like, towards the wall 2' of the bulb 2, to form an essentially funnel-like expanded portion 10, expanding to about twice to four times the diameter adjacent the lamp axis. A plug 11 is left in the tube in the region of the inner axis of the tubular rib 9. Part 7 is looped over rib 9.

The lamp which is shown in FIG. 2 is a 220 V, 100 W halogen incandescent lamp having a filament 15 which is bent in generally U shape. The two legs 8' of the U are essentially parallel to each other, and are subdivided, each, into two light emitting, coiled-coil portions 16 which are connected by single-coiled portions 17. The connection portion 18, extending across the base of the U, also is singly coiled, located transversely to the lamp axis A2, close to the tip 4. Two short portions 19 extend from the ends of the single-coiled portion 17 forming the base of the U, bent-over by about 90°, to the portions 16.

In accordance with a feature of the invention, a glass rib of oval cross section secures the filament 15. It is located at the level of the connecting portions 18. The two halves of the glass rib are formed as elongated rib elements 20 (FIG. 2*b*). They extend over the major portion of the length of the connecting portion 18 of the filament, which, thus, will be pinched between the elongated ribs 20. In addition, the filament 15 is secured in the region of the single-coiled portions 17 by further glass ribs, formed as tubular elements 21. The elements 21 have circular cross section, which, similar to the oval tube, converge from the bulb wall towards the plane of the filament including central axis A2 of the lamp. Plugs 22 are left at the end of the respective tubes, which hold the respective portion 17 at the center thereof by a pinch connection. This way of holding the filament can also be used at the connection part 7 in the embodiment of FIG. 1, when only a single glass rib is used.

Figure 3A:
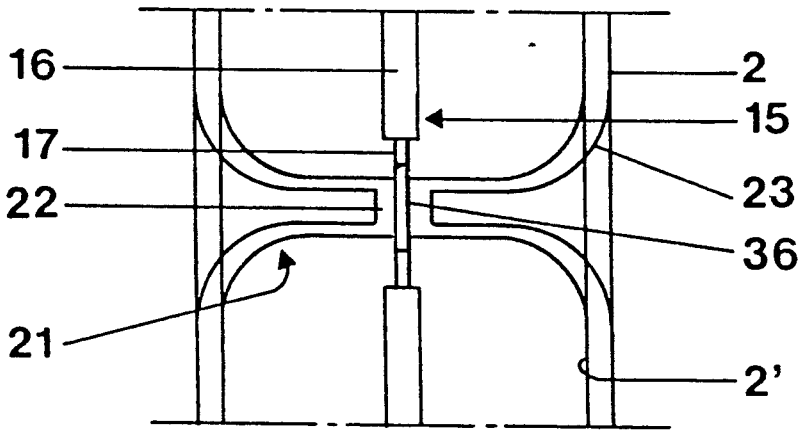

The ribs are formed by pressing punch elements against the wall 2 of the tube, after local heating, for example with a gas burner. FIG. 3*a* illustrates an embodiment of a rib fixing the filament. A funnel-shaped projection 23 at the wall of the bulb is formed to converge to a tubular glass rib 21 of essentially constant diameter, terminating in the middle by a plug 22, within which the filament portion 17 is pinched. The plug has the form of a solid cylinder. To obtain improved cooling in the region of the single-coiled connecting portion 17, a core pin 36 can be inserted within the coil of the connecting portion 17, short-circuiting the individual coils of the coil portion 17 where the core 36 is located. This feature is particularly suitable with ribs which mechanically retain the filament portions, since effective cooling is then particularly desirable.

Figure 3B:
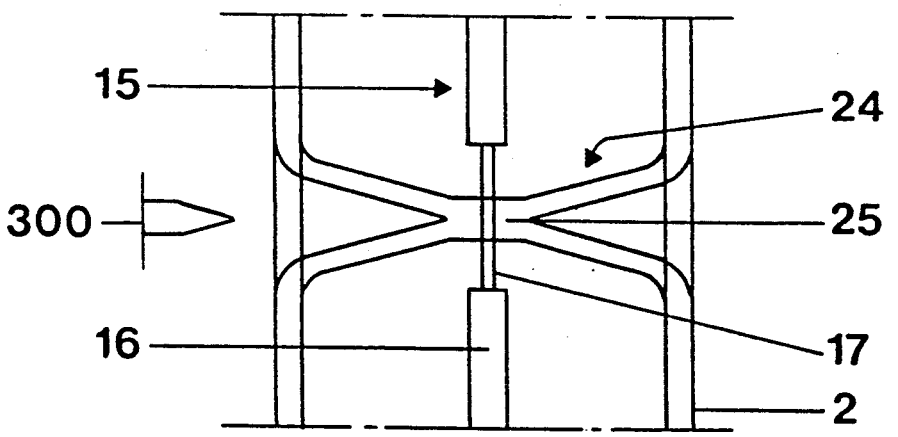

In an alternative form, see FIG. 3*b*, the rib is formed as a continuously converging tubular element 24 made by punch elements 300 which are conically flared. The element 24 has inner walls which smoothly and continuously taper towards each other until the inner plug or stopper region 25 is formed, within which the region 17 of the filament is pinched.

Figure 4A:
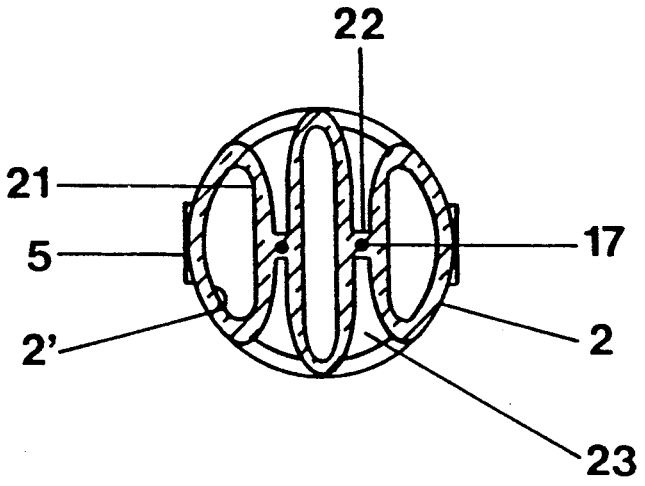

The lamp of FIG. 2 is shown in a highly schematic cross-sectional view in FIG. 4*a* at the level of the funnel-shaped glass tubes 21, which secure in position the respective portions 17 of the filament by a pinch connection.

Figure 4B:
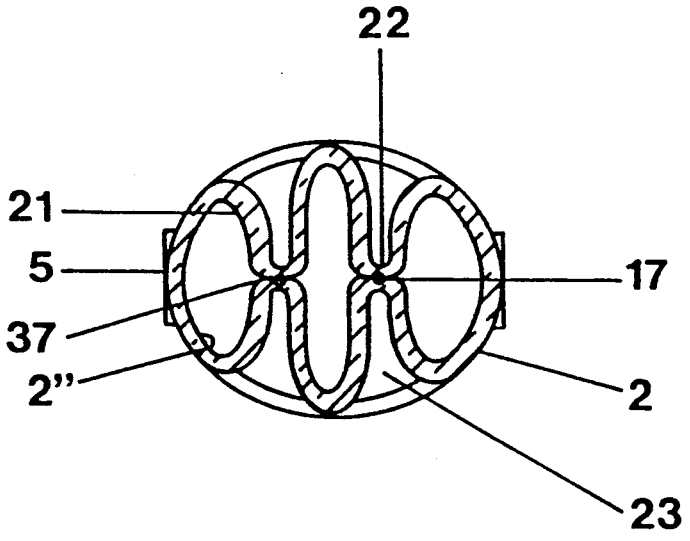

The effectiveness of the pinch is already obtained when the two opposite halves of the rib merely form a common junction 37 in the region of the end plug 22, see FIG. 4*b*, without having an internal homogeneous melt connection. This arrangement is suitable for any one of the embodiments.

FIG. 4*b* illustrates another feature; lamps of relatively large bulb diameter preferably have a flattened cross section which is not circular but, rather, oval or elliptical. The cross section of the bulb 2" can be so selected that the volume of the bulb 2" does not change over that of the bulb 2. The glass ribs, extending from the portion 23, preferably extend from the less curved bulb surface in the direction of the shorter axis; the longer axis of the ellipse is transverse to the direction of the glass ribs. A thicker wall of the glass tubes forming the ribs than from a bulb of circular cross section can be obtained. The axial extent of the rib, or ribs, is very small in relation to the axial length of the bulb—see FIG. 1, for example.

Figure 5:
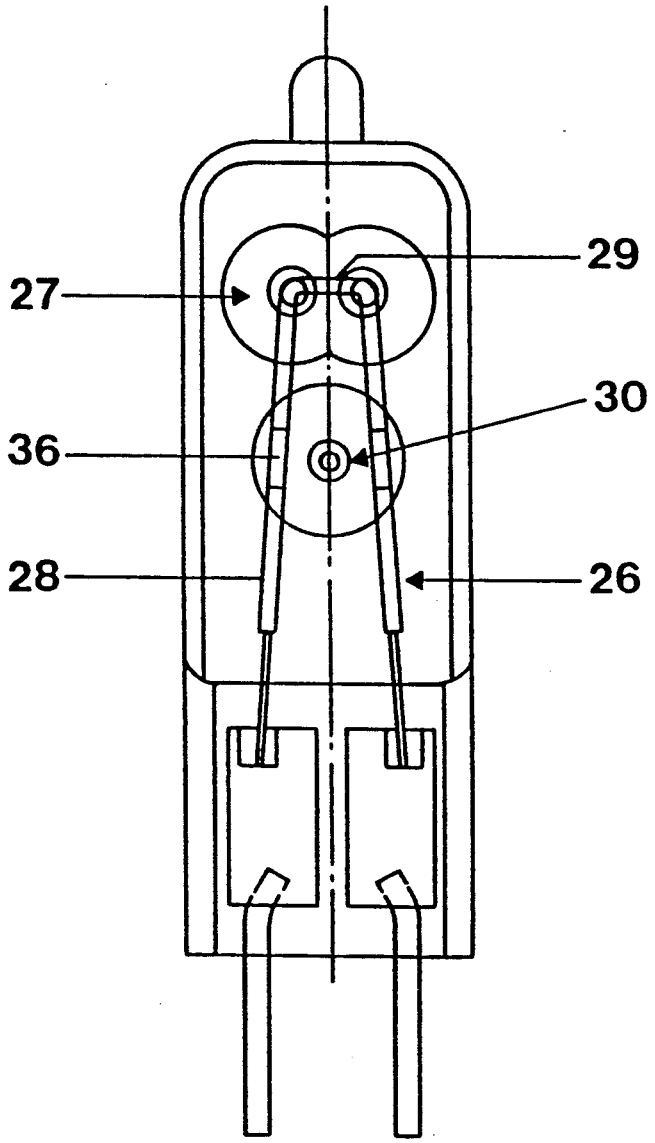
FIG. 5 is a side view of another arrangement of ribs in a lamp.

FIG. 5 illustrates another embodiment; the specific lamp shown is suitable for a rated power of 50 W. The filament 26 is continuously coiled and bent into U shape. Two glass tube ribs 27 retain the U bend in position. They pinch the filament in the region of the approximately 90° bends between the straight legs 28 and the connecting portion 29. The diameter of the ribs is substantially greater, for example by a factor of about 1.4, than in a pinch for a straight portion of the filament, so that the 90° bend of the filament can be completely retained and covered within the pinch. Alternatively, the two glass tube ribs 27 can engage with reduced diameter only against the ends of the transverse connecting portion 29 without including the 90° bends therein. As a further possibility, the bends can loop about the two tubular glass ribs (similar to FIG. 1), for example in the region of the plugs 11 (FIG. 1) thereof.

Generally, the diameter of a tubular glass rib or, for an oval glass rib, the height of a hollow glass rib, should be at least 130%, preferably 200% or more of the diameter of the region of the filament which is to be pinched therebetween in order to ensure a reliable retention of the filament portion.

The lamp of FIG. 5 illustrates a further feature, namely a separating rib 30, located approximately midway within the lamp bulb, so that it will be at a level approximately intermediate the length of the two legs 28. The separating rib 30 is positioned between the two legs 28 and extends transversely thereto. It prevents the comparatively long filaments 28 from engaging or hitting each other, for example under the influence of shock or vibration, when the lamp is lit. The use of one or more separating ribs 30 is desirable if direct positive location of the filament legs should be avoided, or the use of single-coiled or uncoiled portions within the filament in the region of the otherwise coiled-coil legs 28 is undesirable. The separating rib 30, likewise, is formed as a dual funnel-shaped glass separator, having a cross section, for example, as shown in FIGS. 3*a*, 3*b* or 4*a*, 4*b*, respectively, without pinching the filaments however. Insertion of core pins 36 at the level of the separator rib 30 is desirable, in order to prevent premature blackening, or devitrification.

Lamps of this type, particularly since they can be constructed in such compact manner, are especially suitable for use within an outer bulb.

Figure 6:
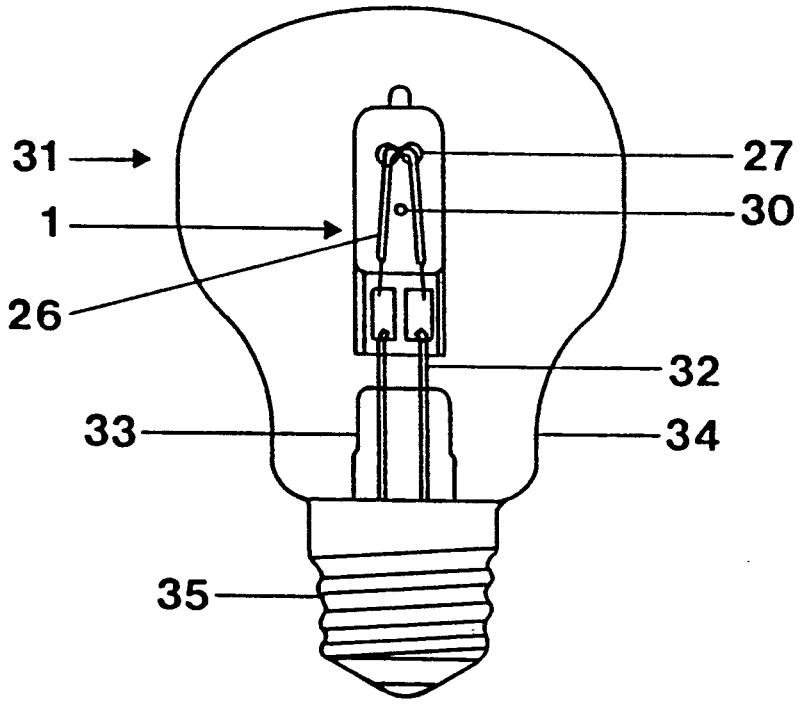
FIG. 6 is a side view of the lamp of FIG. 5 within a globular bulb.

FIG. 6 illustrates a halogen incandescent lamp, for example the lamp of FIG. 5, inserted within an outer bulb 31. The current supply leads 32, which may be in more than one part, are pinch-sealed in a mount 33, for example a flare mount, which in turn is secured within the neck 34 of the evacuated bulb 31. The outer bulb 31 is connected, in well known manner, to a screw base 35.

The lamps are particularly suitable for use in power networks of 110–240 V. The legs of the filament can be subdivided. The fill can be of well known fill components and the halogen additive, for example, can be $CH_2Br_2$. The bulb material, suitably, is hard glass or quartz glass, the light emitting element being coupled to well known massive current supplies, directly melt-sealed in the pinch seal, and for example coupled to external contact pins, connecting leads or the like. The determination which type of glass tubular rib, and in which form and number it is to be used, depends on the temperature relationships, and the free length of the filament itself, as well as on the shape of the filament. As a general guide, the free length of any filament portion should not have a voltage drop thereacross which exceeds about 60 V. Thus, for 110 V (nominal) operation, the U-shaped filament shown in FIG. 6 is suitable. For higher voltages, the filament can be subdivided as shown, for example, in FIG. 2, with each filament portion 16 having a voltage drop thereacross of not more than about 60 V.

The number of glass ribs has to be determined with respect to the power rating of the lamp and the length of the filament as well as with respect to its stability against sagging. Stiff filaments for high power may require, possibly, only a single glass rib. More supple filaments of lower power may require three or more glass rib supports.

The lamps can be made for a wide power range, down to about 15 W, for direct connection to a power network, and suitable for general service illumination.

It is not necessary that the separating rib be formed as a glass tube, extending between opposite side walls, and of essentially circular or oval cross section. The rib can also be formed similarly to a separating wall, punched in from the outside of the bulb, to have a substantial longitudinal extent along the lamp. Cooling of the filament structure in this arrangement, however, is not particularly effective, since the separating wall is comparatively massive.

Referring now to FIGS. 7*a*–7*c*:

The halogen incandescent lamp 701 is a 220 V, 75 W lamp, having an essentially cylindrical bulb 2 of quartz glass with an outer diameter (OD) of about 12.5 mm, an average wall thickness of the wall 2' of about 1 mm, and an internal diameter (ID) of 10.5 mm (with a tolerance of 0.8 mm). The overall length is about 35 mm. The cap 3 has the usual gas pumping tip 4. A pinch seal 5 closes off the bulb. The bulb has a volume of 1.65 $cm^3$, and is filled with a standard inert gas with halide additives, as described above.

The filament 706 is a coiled-coil filament and extends over essentially the entire inner length of the bulb. The base portion 707 of the filament, which is bent in U shape, extends transversely to the axis A7 of the lamp. The two legs 708 of the filament form the luminescent portions thereof; they are about 15 mm long. The arms 708 diverge slightly towards the pinch seal 5. The filament 706 is held by a support frame 709. Frame 709 is bent in a plane, which also includes the axis A7 of the lamp, in such a manner that a cross piece 713 extends transversely between the two legs 710, 711, which extend parallel to the axis A7 and are oppositely positioned against the inner wall 712 of the bulb. The cross element 713 spans across the inner space of the bulb.

In accordance with a feature of the invention, the two legs 710, 711 of the frame are of unequal lengths. The first leg, 710, is substantially longer than the second leg, 711. For example, leg 710 may have a length of about 21 mm, whereas leg 711 is only about 8 mm long. The leg 710 extends into the pinch seal 5 and is embedded therein (see FIG. 7*a*). Shortly beneath the cap 3, the leg 710 is bent over to form the cross element 713. The cross element 713 is undulated, looked at from the front—see FIG. 7*a*—to form three upwardly bowed or bulged regions 714, 714', 715. The first and third portions 714, 714' are bent in essentially semi-circular form; the intermediate bump 715 is bent sharply to form a point 717, and to provide a hook, in combination with the root portions 716, which support the filament 706.

The hook 715 is slightly offset with respect to the plane of the frame, in axial direction. The tip 717 of the hook terminates beneath the cap 3 of the bulb 2.

The base portion 707 of the filament is hooked into the hook 715, so that the ends of the base portion 707 engage the roots 716. The region of the base portion 707, thus, is electrically short-circuited by the frame 709, which is made of metal.

The cross element, in front view, is symmetrical with respect to the axis A7. The respective bumps or humps 714, 714' merge with the respective legs 710, 711 of the frame. The free end 718 of the second leg 711 is left with a cut edge, which may still have a cutting burr on it. This cut edge is not finished.

The frame 710–718 is retained in the bulb by spring tension. Before being installed in the bulb, the two essentially semi-circular regions 714 are outwardly spread.

The two legs 708 of the filament 706 are connected to lead extensions 12, which are short and, for example, single-coiled, and welded to suitable sealing foils 13. The filament 706 is tensioned or stretched by the frame and the retention of the connecting leads 12 in the pinch seal 5. The current supply leads 12 have a length of, for example, about 6 mm and extend by a very short distance, for example 1–2 mm, into the bulb. This short connecting length permits elimination of core pins or the like, which have been used for stabilization of the filament. Contact pins or connections 14 are welded to the sealing foils 13, as well known, and extend upwardly of the pinch seal 5.

In accordance with a feature of the invention, a separating wall 722 extends into the outline of the bulb, along the axis A7 of the lamp, and longitudinally about almost as long as the length of the two filament arms 708. The transition between the cylindrical wall 2 of the bulb and the separating wall 722 is formed by an outwardly bulging region 723. This provides for an essentially homogeneous wall thickness of the bulb, including the depression formed by the separating wall 722. The separating wall 722 has a width of about 1 mm, each wall portion a thickness of about 1 mm, and an axial length of about 10 mm.

Various changes may be made, both in the construction of the lamp as well as in the arrangement of the frame and the relationship thereof to the filament.

Referring now to FIGS. 8*a* and 8*b*:

The general construction is similar to that shown in FIGS. 7*a*–7*c*. The separating portion between the legs of the filaments 808 is not formed as a longitudinally extending wall but, rather, by two funnel-shaped glass tubes 824, extending from the circumference of the bulb wall 2 towards the axis A8 of the lamp, similar to the construction illustrated in connection with FIG. 5. The glass tube 824 has an inner diameter of about 1.2 mm in the vicinity of the axis A8, and extends outwardly towards the wall of the bulb 2 in form of a funnel 825, expanding to between twice to four times its diameter with respect to the diameter close to the axis A8. A plug 826 can be left at the end of the tube 824. The filament 806 is bent in inverted U shape. The two incandescent, luminescent arms 808 are separated into two portions 808*a* and 808*b*. The incandescent portions 808*a*, 808*b* are coiled-coil; the portions 827 are singly coiled. The base portion 807 is either straight, singly coiled or double coiled. The connecting portions 827 have approximately the same length as that of one of the highly luminescent portions 808*a*, 808*b*, that is, about 5 mm long. They are spaced from the glass rib 824 by about 1.5 mm. They can touch the glass rib only if, under shock or vibration, or upon operation in a horizontal direction and sagging of the filaments, the two arms 808 will not have the positions shown in FIG. 8*a*. Thus, problems with respect to blackening of the glass at that location hardly arise.

The filaments can be retained within the glass ribs, as described in connection with FIG. 2, while, simultaneously, being supported at the bend of the U by the frame in accordance with the present invention. FIG. 9*a* shows such a combination in a front view. In general, the construction corresponds to that shown in FIG. 8*a*. Rather than having a single transverse separating rib touching the axis, which under ordinary conditions does not touch the filaments, two hollow glass ribs 924 are provided, extending transversely to the lamp axis (but not touching the axis) approximately in a central region thereof, and transversely to the plane of the filaments 806 at the level of the connecting portions 927 of the filaments. The hollow, tubular glass ribs 924 terminate in the region of the filament portions 927 in end plugs 926 (FIG. 9*b*). The connecting portion 927 of the filament is pinch-sealed or pinch-retained between the glass ribs 924, so that the two luminescent arms 908 are fixed in position, and the free lengths of the filament arms 808*a*, 808*b* are reduced by half with respect to the length of the filament 806. The ribs 924, thus, have the well known function of an intermediate filament support which, previously, usually was a separate wire retained within the bulb and extending intermediate the length of the filament and holding it in position. The meeting, region, seam or junction 932 between the ribs deformed from the side wall of the bulb 2, as can be seen in FIG. 9*b*, is at the frontal areas of the end plugs 926.

Figure 1:
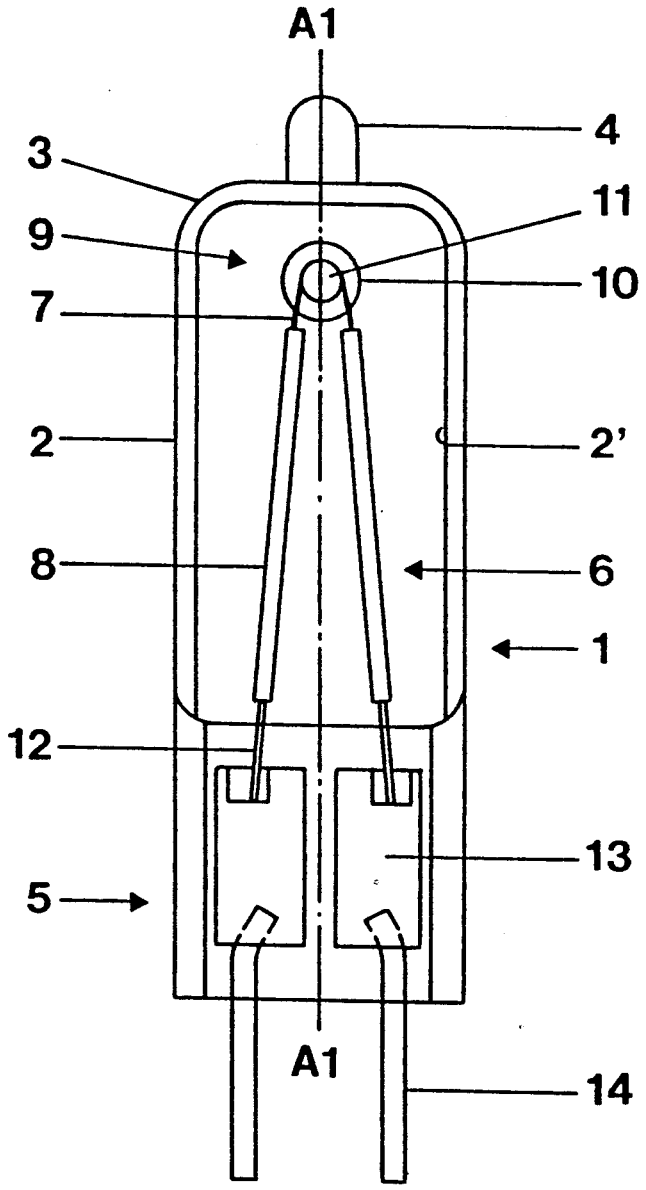
Figure 2A:
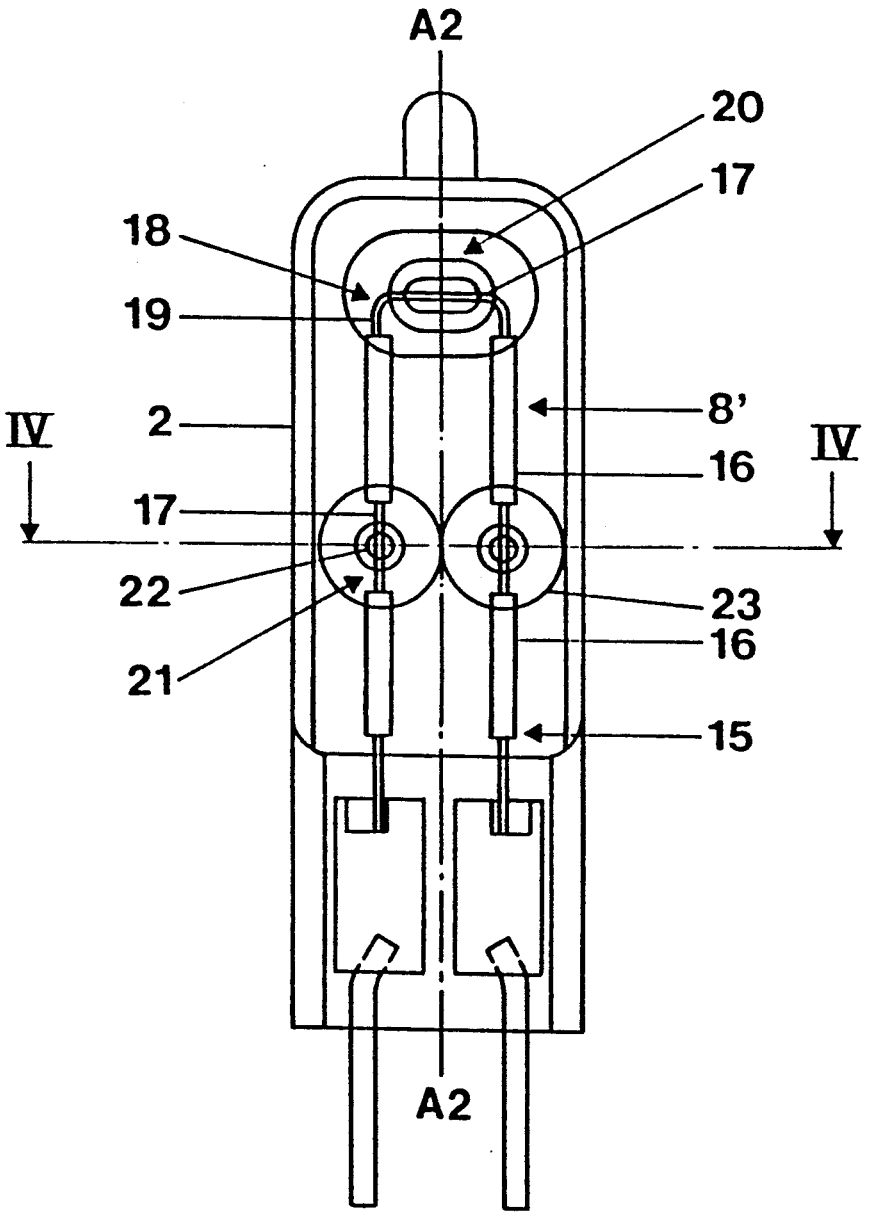
Figure 2B:
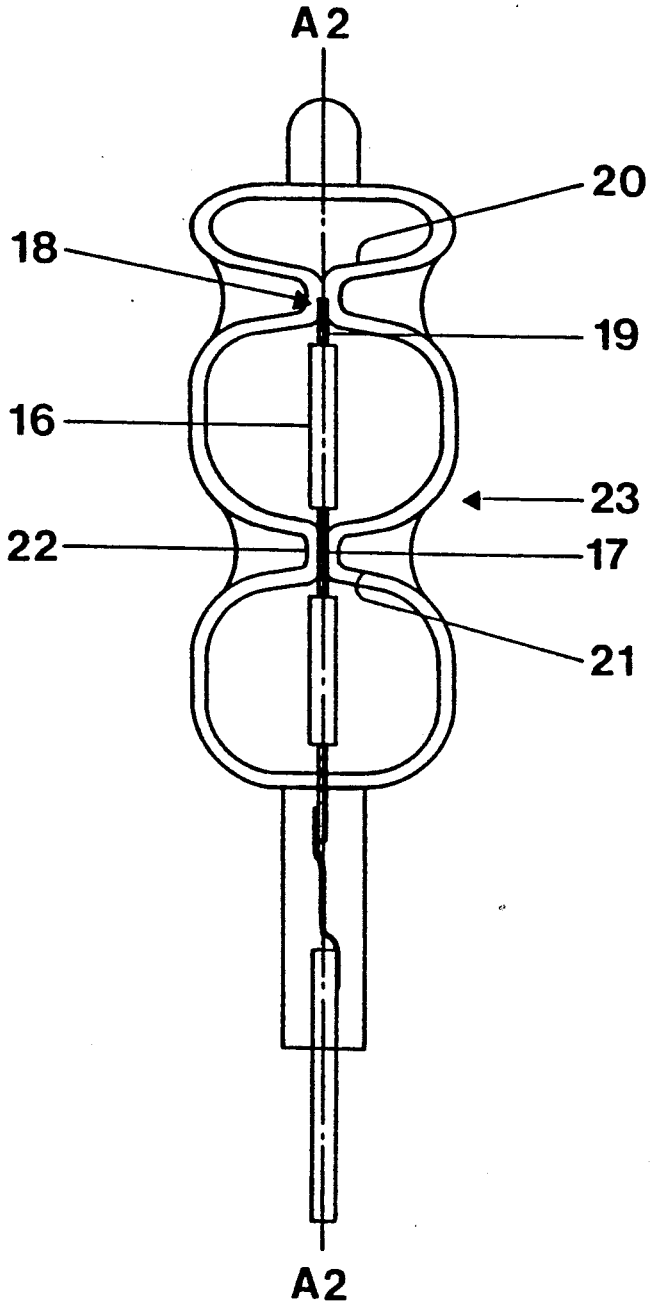

Rather than using two separate inwardly extending ribs 924, one for each one of the filament arms, a single rib extending transversely and including the said two ribs, and having a transversely elongated cross section, for example generally oval cross section as described, for example, in connection with the rib 17, FIG. 2*a*, can be used, located at the approximate region of the two ribs 924 shown in FIG. 9*a*. A connecting duct, between the upper and the lower lamp half should remain, to permit the halogen of the fill within the lamp to operate.

More than one subdivision between the filament portions 808*a* and 808*b*, and more subdivided portions may be used, located longitudinally above each other; the filament 806, then, would be subdivided into three filament portions, each one having one third of the length of the luminescent portion, and connected together by connection regions similar to the connection regions 827. Again, these connecting regions can be supported as described in connection with FIG. 9*a*, or by ribs which extend across the connecting portions 827 of both of the filament legs 808.

The lamp described in connection with FIGS. 7, 8 and 9 is, of course, like all other lamps, suitable for placement within an outer bulb 31, as described in connection with FIG. 6.

The bulb material can be quartz glass; for lamps of lower power, however, for example below 100 W, hard glass can be used. The critical temperature for stresses within the glass of hard glass is below about 600° C. To prevent over-heating of the hard glass, use of core wires which short-circuit the filament or coils of the filament in the region where the filament comes in contact with the glass, for example at the end plugs 826, 926, is recommended. The separating rib 824, FIG. 8*a*, should be spaced from the filaments by at least 3 mm if the bulb is made of hard glass.

The lamp can be made economically, for direct connection to a power network with as low a power consumption as 15 W. The holding arrangement for the filaments as described in connection with FIG. 9*a* is particularly suitable for lamps which are intended for operation in a horizontal position, and may also be used with tubular lamps; it is particularly suitable for lamps of 100 W power rating and below, with bulbs of hard glass. The length of the incandescent filament is, typically, between 1 to 1½ cm.

The frame structure 709–718 can be used also in incandescent lamps which do not use a glass rib, since this frame structure has substantial advantages over that described, for example, in European Published Application 173 995, Westlund et al. It has been found that if the legs 710, 711 of a frame are of approximately the same length, they must be introduced into the lamp in a jig since, otherwise, they will cant. This interferes with the pinch sealing and, particularly, the bent-over end portion in the pinch seal, as described in this patent application, causes difficulty upon pinch-sealing since the legs have the tendency to spread outwardly. During pinch-sealing, of course, the glass is heated and thus is soft and the spring tension of the frame legs has the tendency to cause the softened glass to deviate outwardly, resulting in a high reject rate upon manufacture of the pinch seal, or the formation of fissures, which interfere with gas-tightness of the lamp. Additionally, it is difficult to thread the filament; the threading operation can hardly be carried out automatically. Supporting the top portion of the filament within the exhaust stub 4 substantially interferes with pumping, flushing, and introducing of the fill gas. The arrangement of the lamp described in this publication only permits the use of V bent elements, which has the danger of short circuit at the converging ends of the legs of the V.

The holding frame 709 is accordance with the present invention, in contrast, has the advantage that the length of the leg which is not melted into the pinch seal can be readily matched to the length of the lamp bulb, so that one single frame can be used for various types of bulbs. Introduction can be completely automated, and the inner construction of the lamp substantially simplified. By leaving a cutting burr at the shorter leg 711, self-holding of the wire frame upon introduction into the bulb will obtain. Thus, the position of the holding wire, and hence of the incandescent filament, is precisely determined, and the frame and hence the filament cannot cant. The filament is held in tensioned condition and, if necessary, can be re-tensioned. The shorter leg 711 should be at the most half as long as the longer leg. Surprisingly, the unsymmetrical construction of the legs eliminates difficulties upon tilting or canting and does not introduce twist or tilt into the frame, which had been feared, and which might be expected from a purely theoretical consideration. In actual practice, a length relationship of the two legs 710, 711 of about 3:1 has been found suitable. Canting of the frame might occur if the length of the shorter leg 711 is decreased. substantially. The legs are straight, and engage the inner wall of the bulb 2 throughout their length. The arrangement further does not place any tensioning load on the pinch seal 5, since hardly any remaining outwardly directed spring forces will be applied thereagainst. Most of the spring forces due to the springiness of the frame distribute themselves along the entire inner wall of the bulb 2, thereby substantially increasing the tightness of the lamp and hence its lifetime. The shortened leg has the additional advantage that shading of light emitted from the filament is reduced.

The hook-like arrangement determined by the central hook 717 (FIG. 7*a*) simplifies hooking the filament 706 into the frame, thus eliminating any threading operation, and, hence, placement of the filament structure and frame can be readily automated. The tip 717 of the hook preferably, engages against the caps 3 of the bulb 2, which provides a simple way of readily determining an abutment stop which controls the correct positioning and insertion depth of the frame.

Short-circuiting of the portion of the filament between the roots 716 of the central projection is deliberately accepted, so that the two highly incandescent portions of the filament are spread apart, much more so that in a V-shaped filamentary arrangement, and danger of short-circuiting between opposite legs, and hence reduction in lifetime or immediate burn-out of the filaments is avoided.

The concept of providing a frame with non-symmetrical frame legs, and of forming supports for the filaments directly from the material of the glass bulb, can be used also with filaments which extend longitudinally of the lamp and in the lamp axis. Single-ended lamps of this type have a current supply lead which extends from the connection end to the cap end of the bulb and which, at the same time, may also form part of a holding arrangement for the axially positioned filament.

Referring now to FIGS. 10 and 11:

Lamp 1001 is a 120 V, 90 W lamp, having a cylindrical outer bulb 2 of quartz glass with an overall length of about 4 cm. It has a rounded cap 3 and an exhaust-and-fill tip 4. The other end of the bulb 2 is sealed with a pinch seal 5, from which leads 14 extend, for example for connection to a base of ceramic or the like—now shown. Two molybdenum foils 13*a*, 13*b* are asymmetrically positioned in the pinch seal 5, and, respectively, connected to the outer leads 14 and to inner current supply leads 1007 and 1008. The first current supply 1007, made of tungsten wire, is long and guided along the inner wall 1009 of the bulb 2 towards the cap end of the bulb. The end 1010 of lead 1007 is bent inwardly away from the inner wall 1009 of the bulb 2 and towards the connecting foil 13*a*, located at a lateral end portion of the pinch seal. The end 1011 of the lead 1007 is bent inwardly towards the axis A10 of the lamp to form a first inclined portion 1012*a*, bent upwardly to form an angle of about 60° with respect to the lamp axis A10. Shortly before this portien meets the lamp axis, a sharply reverse bent portion 1013 is fitted thereon; it can be unitary with the entire current supply lead 1007. It is hair-needle shaped and formed by a leg 1013*a* and, immediately adjacent, a downwardly extending leg 1013*b*. The bend 1014 of the portion 1013 is directed towards the pumping tip 3. It is, however, spaced therefrom, as can be clearly seen in FIG. 10, by a sufficient clearance distance.

In accordance with a feature of the invention, the current supply lead 1007 is in form of the frame. The frame formed by the current supply lead 1007 is mirror-symmetrical with respect to the lamp axis in the upper region thereof. Thus, symmetrical to the first leg 1013*a* and the first inclined portion 1012*a*, a second 1013*b* and the second inclined portion 1012*b* are provided. The second inclined portion 1012*b* ends at the opposite inner wall 1009' and terminates in a short extension 1015, bent over to follow the inner wall 1009', and direct it towards the pinch seal 5. This retains the inner current supply 1007 resiliently between two diametrically oppositely positioned points or regions of the inner wall of the bulb and centers the filament 1016 automatically in the axis A10 of the lamp.

The filament 1016 has two double-coiled or coiled-coil portions 1017; it is axially retained in the bulb between the second sealing foil 13*b* and the portion 1013, by being stretched or tensioned therebetween. The two coiled-coil portions 1017 are separated from eacn other by a single coil connecting portion 1018. The end portion 1008 likewise is singly coiled, and extends in a straight line from the highly light emitting portion 1017 to the second foil 13*b*, positioned symmetrically in the axis A10 of the lamp, and in the middle of the pinch seal 5. This construction substantially simplifies the overall lamp, since it eliminates the need for a second current supply to the filament, by using a portion of the frame thereof. Further, and unexpectedly, an additional safety feature is obtained since the end portion 1008 of the filament is pinch-sealed into the pinch seal 5. This leaves a short duct or channel. If, due to over-voltage or other malfunction, an arc should strike between the current supply leads within the bulb, the filament portion 1008 will vaporize, thus immediately suppressing any dangerous continuous arc formation.

The connecting portion 1018 of the filament 1016 is fixed in position within the bulb by a glass rib 1019, extending transversely to the lamp axis A10, and to the first current supply lead 1007. The glass rib 1019, in accordance with a feature of the invention and as heretofore described, is hollow and extends, from both sides of the bulb, up to approximately the center thereof. The glass tube, close to the lamp axis A10, has an interior diameter of about 1–2 mm, and extends, funnel-shaped, towards the wall of the bulb with a final diameter of between two to four times the minimum diameter.

In its simplest form, the tubular rib extending from both sides of the bulb, has circular cross section. In accordance with a feature of the invention, in a preferred form for longer filaments, as best seen in FIGS. 10 and 11, the rib is of transversely stretched or oval cross section, at least in the region close to the central axis A10 of the bulb. This facilitates locating the filament precisely in position. The longer axis of the hollow rib extends transversly to the lamp axis A10 and, hence, to the major direction of the filament 1016. The relationship between the longer and the shorter axis of this hollow rib is approximately 2:1. The connection portion 1018 of the filament is squeezed or pinched between the two oppositely extending rib portions 1019*a*, 1019*b* (FIG. 11). Adjacent the center axis, a plug 1020 will remain in each one of the inwardly projecting ribs 1019*a*, 1019*b*.

The rib 1019 carries out a portion of the function of a holding frame. A further holding function is obtained by the inner current supply lead 1007, which retains the end of the filament 1016 in position at the end close to the cap 3 of the bulb. The filament 1016 adjacent the upper end, in formed with a connecting portion 1018', which is, in turn, connected to a double-coiled or coiled-coil end portion 1021. This end portion 1021 is threaded on the reversely bent region 1013 of the current supply lead 1007. The two spreading legs 1012*a*, 1012*b* ensure that the end portion 1021 cannot slip off. Preferably, the intermediate connecting portion 1018' is only single-coiled.

FIG. 12 shows a lamp 1201 designed for connection to a 230 V supply. Due to the higher voltage than that of the lamp 1001, the filament is subdivided into three brightly incandescent portions 1222, separated by connecting portions 1223. Each one of the connecting portions 1223 is secured in position within the lamp by a respective dual glass rib 1224, for example similar to the glass rib 1019 of FIGS. 10 and 11. The upper portion of the filament 1221 is again retained as previously described; current is supplied by a current supply lead 1207.

The lamps of FIGS. 10 and 11 are particularly suitable for incorporation into an outer bulb and, especially, for incorporation in a reflector bulb, where placement of the filament in a focal plane is desirable. FIG. 13 illustrates the lamp 1001 in a PAR relfector 1326. The two external current supply leads 14 are connected and retained with a flare mount 1327, which is retained in a base 1329, formed with a screw base connection 1328. The outer bulb 1325 is evacuated.

The connection of the filament 1016, may, also, be positioned transversely in the pinch seal. This may simplify the overall construction, since then the necessity of bending the current supply lead connected to the centrally positioned foil may not be necessary. Of course, such an arrangement requires use of the filament 1016, or a portion 1008 thereof, as the current supply lead to the foil.

The glass bulb 2 may have either circular cross section or, particularly for longer bulbs, oval cross section, for example elliptical, which can be of advantage, see FIG. 4*b*. The connecting ribs 1019 then should extend in the direction of the shorter axis to ensure an appropriate minimum thickness of the glass ribs.

The arrangement of the frame formed by the current supply lead 1007, in accordance with the invention, has a substantial advantage over prior art structures, such as, for example, disclosed in the referenced U.S. Pat. No. 3,840,953, Martin. By placing the current supply lead against the inner side wall, and providing a second and short leg 1015, the two inclined portions ensure precise centering of the filament, important when combined with a reflector. The angle which the inclined portions 1012*a*, 1012*b*, each, form with respect to the lamp axis can vary widely, and may be between 10° to 80°. Eliminating a connection of the holding arrangement for the filament with the cap end of the bulb facilitates evacuation, flushing and filling of the bulb.

The feature of the present invention, namely deforming the bulb to provide support and/or separating portions extending inwardly of the bulb can also be used with tubular lamps known as T lamps or lumiline lamps, and is therefore particularly applicable since sag-through of elongated filaments can be easily avoided without interfering with overall light output. Such lamps are usually double-ended, that is, have pinched seals at both ends, although this is not a necessary requirement for use of the present invention.

Referring to FIGS. 14*a* and 14*b*:

The lamp 1401 is a 220 V, 150 W lamp, suitable for direct connection to a 220 V network. It has an elongated cylindrical bulb 1402 of quartz glass with an inner diameter of about 7 mm. The overall length of the lamp is about 105 mm. The central region is formed with an exhaust and fill tip 1403. The fill may be any standard fill above described, including a halogen additive. The two ends of the bulb are sealed by pinch seals 1404, 1405.

The filament 1406 extends axially between the pinch-sealed ends 1404, 1405. It is coiled-coil, that is, double-coiled, extending over almost the entire inner length of the bulb 1402. The wire diameter, for example, is about 0.053 mm; the outer diameter of the secondary winding is 0.58 mm. Single coiled end portions 1407 connect the filament 1406 to molybdenum foils, not specifically shown, in accordance with well known pinch seal technology, within the pinch seals 1404, 1405, from which terminals extend towards ceramic bases 1408.

In an alternative construction, a lamp similar to that described and suitable, for example, for 150 W, has a single coiled filament 1406 in which the end portions 1407 are uncoiled or straight. In the drawings, the aspect of the filament will be the same.

In accordance with a feature of the invention, four supports ribs 1409, formed as hollow rib elements, support the filament 1406 intermediate its length. The support ribs 1409 extend transversely to the lamp axis; they are placed in a row, and subdivide the filament 1406 into similar sections 1410 of the same length. These sections will be short and, thus, in use will not hang through. The cross ribs 1409 are formed of the same material as the material of the bulb; they extend between two opposite regions of the wall 1402' of the bulb, towards the central axis A14 of the lamp.

The cross ribs are generally funnel-shaped, and symmetrically positioned. Starting from the wall 1402', they converge smoothly continuously towards the inside of the bulb. This is a preferred form since, thereby, thin-walled sections and thin spots or regions can be avoided. Adjacent the inner axis A14, the tubular cross ribs 9 have a diameter of about 1.2 mm, and expand outwardly towards the wall 1402' to two to four times the minimum diameter. A solid plug 1411 will be formed at the terminal end of the rib which can be considered a full or solid cylinder. The height of this full or solid cylinder corresponds, approximately, to its diameter. A short portion 1412 of the filament 1406 is pinch-retained or sealed between the oppositely facing plugs 1411, thereby retaining the filament in position.

The number of the ribs 1409 can be suitably selected in dependence on the power rating of the lamp, and the length of the filament 1406, and its stability with respect to hang-through. One cross rib 1409 may be sufficient for a short, low-power lamp. More than four cross ribs 1409 may be desirable for high-power lamps, for example six or more.

If the number of cross ribs, for example more than four, increases, it may be desirable to place the cross ribs as shown in FIG. 15, that is, extending form the wall 1502 of the lamp offset alternatively by 90°, rather than being in a single plane (FIGS. 14*a*, 14*b*). Thus, the lamp 1501, with filament 1506, and an exhaust tip 1503, has a group of ribs 1509*a* extending, with respect to FIG. 15, in a vertical plane, and alternate ribs 1509*b*, extending in a plane transverse to the plane of the FIG. 15. Additional ribs, rotated by only 45° instead of 90° with respect to the first rib can also be used. The filament 1506 can be a single-coiled filament, as schematically shown at 1510, or a coiled-coil filament. Ribs 1509*a* and 1509*b*, respectively, extend to lamp axis A15.

FIG. 16 is a detail view of retention of a filament 1606, used in a 100 W lamp. The filament 1606 has double-coiled portions 1610, connected by connecting portions 1613, which are single-coiled. The filament 1606 is held in position within the solid plug 1611 of the essentially funnel-shaped rib 1609. The rib 1609 is positioned at the level or in alignment with the connecting portion 1613.

This construction is particularly desirable for filaments of comparatively large outer diameter of the secondary winding, since coiled-coil filaments, upon being melt-sealed in a pinch seal, have a tendency to distort and twist or untwist. This particular arrangement is suitable for lamps with a power rating of up to about 200 W, in which, also, the temperature of a coiled-coil filament would be so high that stresses and possible devitrification within the glass may occur, and, further, the bulb may blacken.

FIG. 17*a* illustrates another arrangement in which the ribs 1714 are formed as tubular elements of essentially constant diameter over a substantial portion of their length, flaring outwardly only close to the wall 1702 of the bulb 1402, in form of a trumpet bell or acoustical bell 1415. The filament portion 1710 which is to emit light is coiled-coil or double-coiled; the connecting portion 1713 is single-coiled and has a core pin 1718 of molybdenum inserted therein. The cross rib 1714 engages the connecting portion 1713 of the filament at the level of the core pin 1718. The two end portions 1711 of the two halves of the tubular rib 1714 are closed. The two end portions to not touch each other, leaving a space not filled by glass therebetween, which space is occupied by the connecting portion 1713 of the filament.

FIG. 17*b* illustrates a variation with respect to FIG. 17*a*. The two halves of the ribs 1714 are melted together, but only partially seamed or connected, so that in the axis of the lamp, a joint or seam or junction 1719 will remain between the respective end portions or plugs 1711 of the halves of the ribs 1714. The diameter of the rib flares out continuously, increasing non-linearly, from the central region of the bulb to the bulb wall. This type of rib can readily be made by first heating the region of the outer wall 1702 and then, while continuing to heat, introducing a rod-shaped punch 1720 in the direction of the arrow 1720'—while continuing to supply heat. This shape of the rib is also advantageous with the other lamp types previously described.

This method ensures uniform wall thickness of the wall 1702'. Differently shaped ribs require suitable variation in the speed of introduction of the punch 1720 and/or heat supply, as well as the extent of heat supply, and the force with which the punch 1720 is introduced as shown schematically by the arrow 1720'.

FIG. 18 illustrates an embodiment in which the filament coiling is highly pitched. The filament 1806 is continuously coiled. The individual windings of the filament are schematically shown, and the envelope 1806'' is shown in broken lines. The funnel-shaped rib 1815 extends from both sides of the wall 1802 of the bulb, but is inclined and intersects the axis A18 of the lamp at an acute angle so that one turn of the highly pitched wound filament 1806 is threaded about the glass rib 1815. The glass rib 1815 is formed as a continuous hollow cylinder or with a central plug 1811. The outer diameter of the plug 1811 matches, at least approximately, the spacing of a single winding of the filament 1806.

The angle which the rib 1815 forms with the lamp axis A18 preferably is the same as the pitch angle of the filament 1806, since this ensures holding of the filament and, further, permits the diameter of the rib 1815 to be comparatively large. In general principle, the rib 1815 could be located transversely to the axis A18, as shown, for example, in connection with the rib 1509 (FIG. 14); the filament could be so wound that, in the region of the ribs, it has a particularly wide portion to wrap itself around the rib.

A continuously coiled filament 1917*a*, 1917*b* (FIG. 19) is retained by glass ribs 1916 which, however, do not intersect with the filament. Rather, the glass ribs are located alternatingly, above and below the filament 1917*a*, 1917*b*, such that some, for example 1916*a*, 1916*c*, are above the filament and the alternate ones, namely 1916*b*, 1916*d* are therebelow, with respect to a horizontal operating position, as illustrated by the lamp axis A19. This arrangement has the advantage that the filament can be made without considering the dimensions of the winding or coiling thereof. The connecting portions need not be considered. Preferably, short core wires 1918 can be placed or left within the coils of the filament, as shown with respect to the filament portion 1917*a*. The cross ribs can be tubular or funnel-shaped; preferably, the diameter of the ribs adjacent the filament is so selected that it is substantially larger than the pitch of the respective filament portion 1917*a* which, then, can be comparatively narrow. Alternatively, and for some other portions of the filament, the diameter of the ribs 1916*c*, 1916*d* can be so dimensioned that it is substantially less than the pitch of the filament portions 1917*b*, so that the respective filament portions can fit into, and partially surround the end portions of the rib, adjacent the filament. This arrangement may be combined, as shown in FIG. 19, or the filament, throughout, can be constructed as shown on the left side, or at the right side, as desired, and as required by filament construction and power rating of the lamp.

The support ribs need not be narrow; FIG. 20 illustrates an embodiment suitable, for example, for a 110 V lamp 2025, which has a support rib 2026 which is essentially bubble-shaped. The two half-portions or half-sections of the support rib 2026 are concavely curved and engage a single-coiled or straight portion 2027 of the filament 2028 which, normally, would be coiled-coil or double-coiled. The longitudinal extent of engagement of the rib 2026 with the portion 2027 of the filament may be in the order of about 7 mm.

The terms pitch, winding, coiling, and the like, unless otherwise modified, refer always to a secondary coil of a coiled-coil winding, or, respectively, to the single coil is only single-coil winding is used.

The lumiline lamp in accordance with the present invention is particularly suitable for lamps of general service use and of lower power consumption, that is, between 15 to 100 or 200 W ratings, where price of the lamp is a major consideration. The simplicity of construction, and the simplicity of manufacture, which can be automated, permits furnishing of halogen incandescent lamps for general service use at a competitive price. The lamp is also suitable for power consumption up to 2000 W.

Various changes and modifications may be made; any features described in the specification may be used with any of the others, and features described in connection with any one of the embodiments may be used with any of the other embodiments; for example, the shapes of the ribs, discussed in connection with lumiline lamps may also be applicable to single-ended lamps.

Furthermore, the frame structures described in connection with FIGS. 7 through 12 may also be used with lamps other than halogen incandescent lamps.

We claim:

1. A halogen incandescent lamp (1), particularly for connection to a network voltage supply of 80–250 V, 50–60 Hz, having a bulb (2) of transparent material defining a lamp axis, said bulb having two end portions (3, 4, 5) and bulb walls (2'), said bulb being closed at said end portions, wherein at least one of said end portions is closed by a pinch seal;

current supply means passing through at least one of said end portions;

a filament coupled to said current supply means, and positioned in said bulb in a predetermined location therein;

a fill including an inert gas with a halide additive within said bulb; and a positioning means for said filament, wherein said positioning means comprises at least one protuberance means (9, 20, 21, 27, 30; 722, 824, 924, 1019, 1224, 1412, 1509*a*, 1509*b*, 1609, 1714, 1815, 1916, 2026) of said material extending transversely with respect to a plane passing through the lamp axis, from two spaced regions of the wall of the bulb (2) toward said plane passing through the lamp axis and positioning or helping to position said filament within said bulb.

2. The lamp of claim 1, wherein said protuberance means comprises a portion of the bulb wall deformed from the bulb wall and projecting inwardly towards the filament.

3. The lamp of claim 1, wherein said protuberance means is located in a plane intersecting said axis.

4. The lamp of claim 1, wherein said protuberance means extends inwardly from the wall (2) of the bulb towards said axis from diametrically opposite regions of the bulb.

5. The lamp of claim 1, wherein the filament has two legs defining a plane;

and wherein the protuberance means extend transversely to the axis of the lamp and to said defined plane.

6. The lamp of claim 5, wherein the filament is bent in essentially inverted V shape or U shape, and includes a connecting portion (7) adjacent the apex of the V or the base of the U;

and wherein said protuberance means comprises a support rib means supporting said connecting portion (7).

7. The lamp of claim 6, including further protuberance means (21) positioned for engagement with the legs of the V-shaped or U-shaped filament.

8. The lamp of claim 1, wherein the filament is pinch-connected to at least one of said protuberance means.

9. The lamp of claim 1, wherein at least one of said protuberance means is positioned within the bulb for mechanically engaging and supporting said filament.

10. The lamp of claim 1, wherein the protuberance means comprises hollow projections extending from the walls (2) of the bulb inwardly towards the axis of the lamp.

11. The lamp of claim 10, wherein, adjacent the walls (2) of the bulb, the projections are tubular and flare outwardly to form a generally funnel-shaped end portion merging with the wall of the bulb.

12. The lamp of claim 1, wherein the filament is divided into a plurality of filament portions and at least one connecting portion, electrically and mechanically connecting the filament portions; and said filament portions are coiled-coil wound, and the at least one connecting portion is single-coiled or uncoiled and straight.

13. The lamp of claim 12, wherein said protuberance means engage the filament in the region of the connecting portion.

14. The lamp of claim 1, wherein the filament is bent in essentially inverted V shape or U shape, and includes a connecting portion (7) adjacent the apex of the V or the base of the U;

and wherein said protuberance means has an oval cross-sectional profile and engages the connecting portion (7) of the filament.

15. The lamp of claim 1, wherein said bulb has circular cross section.

16. The lamp of claim 1, wherein the cross section of said bulb is flattened or oval;

and the protuberance means extend in a direction parallel to the shorter half-axis of the ellipse or oval.

17. The lamp of claim 1, wherein the filament in the region adjacent the protuberance means is a coiled filament;

and a core pin or mandrel (36) is inserted in the coiled filament to reduce thermal loading on said protuberance means.

18. The lamp of claim 1, wherein the positioning means further includes a support means or frame (710; 1007).

19. The lamp of claim 1, wherein said lamp is a single-ended lamp having a bulbous portion at one said end portions, the filament is bent in V or U shape defining legs;

and wherein at least one of said protuberance means is positioned between the legs of the filament for positioning the legs of the filament in relatively separated position to prevent contact between the legs of the filament upon sagging of the filament in operation of the lamp.

20. The lamp of claim 19, wherein said protuberance means comprises at least one separating rib (722; 824).

21. The lamp of claim 19, wherein said protuberance means (722) comprises an elongated strip (722) positioned between the legs of the filament for supporting the filament legs in supported condition even upon sagging of the filament legs during operation of the lamp.

22. The lamp of claim 1, wherein the protuberance means comprises tubular projections extending from the walls (2) of the bulb inwardly towards the axis of the lamp; and wherein said tubular projections flare outwardly towards the wall of the bulb to form a smooth junction therewith, having a diameter of between about twice to four times the minimum diameter of the tubular projection.

23. The lamp of claim 1, wherein the protuberance means comprises tubular projections extending from the walls (2) of the bulb inwardly towards the axis of the lamp; and wherein said tubular projections, extending from spaced portions of the wall of the tube, are closed in the vicinity of said axis and form a closing plug (1020).

24. The lamp of claim 18, wherein the filament (1016) is an axially extending filament positioned along said axis of the lamp;

wherein the support means or frame comprises a metal frame (1007, 1012, 1013, 1014, 1015) which forms one of said current supply means, said frame having a first straight frame portion (1007) extending along the wall of the bulb;

and wherein said protuberance means (1019) extends from diametrically opposite regions of the bulb at a longitudinally intermediate portion of the filament and retaining said filament in a pinch connection.

25. The lamp of claim 24, wherein said protuberance means is a single transversely extending rib (1019) engaging the filament (1016) centrally intermediate its axial length.

26. The lamp of claim 18, wherein said support means or frame (1007) is formed with an upwardly inclined portion (1012*a*) angled off towards the axis (A10) of the lamp approximately at a level of the end of the filament which is closest to a first end portion (3, 4) of the bulb (2), said upwardly inclined portion (1012*a*) being connected to a holding portion (1013), said holding portion being coupled to a downwardly inclined portion (1012*b*) and having secured thereto a further straight portion (1015), said further straight portion engaging the inner wall (1009') of the bulb, and terminating intermediate the length of the bulb, whereby said first straight frame portion (1007) and said further straight portion (1015) will be non-symmetrical.

27. The lamp of claim 26, wherein said first and second inclined portions form bent or bowed portions (714, 714'), and the holding portion is a hook-like element (716, 717) into which said filament is hooked.

28. The lamp of claim 26, wherein the filament (1016) is mechanically retained at one end portion by said current supply means;

and wherein said holding portion is a sharply reversely bent, hair needle portion (1013) having two closely adjacent legs (1013*a*, 1013*b*), said filament being a coiled filament having a second end portion (1021), said second end portion being wrapped around both of the legs of the sharply bent holding portion.

29. The lamp of claim 1, wherein said lamp is a double-ended tubular lamp;

said filament extends axially within said tubular lamp having two end portions (1407), said end portions being connected to said current supply means (1408);

wherein a plurality of said protuberance means (1409) are provided and wherein at least one of said protuberance means is positioned between the respective end portions of the filament.

30. The lamp of claim 29, wherein the plurality of protuberance means are, respectively, positioned along the length of the tubular bulb (1402).

31. The lamp of claim 30, wherein the protuberance means extend transversely to the axis (A14) of the lamp, and are alternately positioned above (1916*a*, 1916*c*) and below (1916*b*, 1916*d*) of the lamp axis and mechanically supporting the filament (1917*a*, 1917*b*).

32. The lamp of claim 30, wherein said protuberance means are located in a single plane which intersects said lamp axis.

33. The lamp of claim 30, wherein said protuberance means (1509*a*, 1509*b*) are located, alternately, in two perpendicular planes which intersect at said lamp axis.

34. The lamp of claim 1, wherein said protuberance means comprise tubular portions having a wall thickness which is approximately the same as the thickness of the walls of the bulb, said tubular portions extending from regions of the wall of the bulb (2) in a plane which is perpendicular to said lamp axis.

35. The lamp of claim 1, wherein said protuberance means extend from opposite sides of the bulb and are positioned in a plane which intersects said bulb axis at a angle.

36. The lamp of claim 1, wherein said filament is a coiled filament;

said filament engages said protuberance means, and the outer dimension of said protuberance means in the region of engagement with said filament is dimensioned relative to the coil pitch such that the protuberance means will be at least partially surrounded by one of the filament coils.

37. The lamp of claim 1, further including an outer bulb (34), optionally including a reflector (1325) surrounding said bulb, and having a base electrically connected to said current supply means and mechanically supporting said halogen incandescent lamp.

38. The lamp of claim 1, wherein said protuberance means in the region of said lamp axis has a dimension of between 0.5 to 2 mm.

39. The lamp of claim 1, wherein the axial extent of said protuberance means is small with respect to the axial length of said bulb and optionally terminates in a point adjacent said plane passing through the axis of the filament.

40. A lamp having a bulb (2) of transparent material defining a lamp axis, said bulb having bulb walls (2'), and a first end portion (3, 4) and being sealed at said first end portion;

current supply meas passing through a second end portion;

a filament structure coupled to said current suply means, and positioned in said bulb in a predetermined location therein; and a fill including a gas in the bulb;

and comprising at least one protuberance means (9, 20, 21, 27, 30; 722, 824, 924, 1019, 1224, 1412, 1509*a*, 1509*b*, 1609*b*, 1714, 1815, 1916, 2026) of said material extending inwardly toward the axis or middle plane of the lamp from two spaced regions of the wall of the bulb.

41. The lamp of claim 40, wherein the lamp is a halogen incandescent lamp and the bulb material as well as the protuberance material comprise quartz glass or hard glass.

42. A method of making a halogen incandescent lamp as claimed in claim 40 comprising the steps of introducing the filament into the bulb;

heating selected portions of the wall of the bulb to softening temperature;

deforming the heated softened portions to converge towards each other interiorly of the outline of the bulb to thereby form said protuberance means; and permitting said so deformed bulb, with the protuberance means therein, to cool.

43. The method of claim 42, wherein said deforming step comprises moving an essentially rod-like punch element (1720) towards the softened wall portion.

44. The method of claim 42, wherein said deforming step comprises moving a punch element (300) which is conically flared towards said wall portion, said conical flare forming an outer conical portion of the protuberance means.

45. The method of claim 42, wherein said deforming step comprises moving two punches from opposite sides of the bulb towards each other unitl the deformed wall portions just touch to form a seam or junction.

46. The method of claim 45, wherein said deforming step further includes the step of pinching a portion of the filament between the deformed portions.

47. The method of claim 42, wherein said deforming step comprises sealing said bulb; then evacuating the bulb from an exhaust or pumping tube, to collapse the softened wall portions twoards each other and form said protuberance means;

then filling the bulb; and tipping off the exhaust tube (3).

* * * * *